US010270170B2

(12) United States Patent
Foster et al.

(10) Patent No.: US 10,270,170 B2
(45) Date of Patent: Apr. 23, 2019

(54) COMPOUND LOOP ANTENNA SYSTEM WITH ISOLATION FREQUENCY AGILITY

(71) Applicant: DOCKON AG, Zurich (CH)

(72) Inventors: Matthew Robert Foster, San Diego, CA (US); Jonathan Neil Bringuier, Carlsbad, CA (US); Ryan James Orsi, San Diego, CA (US); Forrest James Brown, San Diego, CA (US); Alexandre Dupuy, San Diego, CA (US)

(73) Assignee: QuantalRF AG

( * ) Notice: Subject to any disclaimer, the term of this patent is extended or adjusted under 35 U.S.C. 154(b) by 0 days.

(21) Appl. No.: 15/351,300

(22) Filed: Nov. 14, 2016

(65) Prior Publication Data

US 2017/0062932 A1 Mar. 2, 2017

Related U.S. Application Data

(63) Continuation-in-part of application No. 14/253,678, filed on Apr. 15, 2014, now Pat. No. 9,496,614.

(51) Int. Cl.
*H01Q 7/00* (2006.01)
*H01Q 1/48* (2006.01)
(Continued)

(52) U.S. Cl.
CPC ..... *H01Q 7/00* (2013.01); *H01Q 1/243* (2013.01); *H01Q 1/38* (2013.01); *H01Q 1/48* (2013.01); *H01Q 1/525* (2013.01); *H01Q 5/371* (2015.01)

(58) Field of Classification Search
USPC ..... 343/700 MS, 702, 729, 867
See application file for complete search history.

(56) References Cited

U.S. PATENT DOCUMENTS 4,987,421 A 1/1991 Sunahara et al.
5,952,982 A 9/1999 Jorgenson et al.
(Continued)

FOREIGN PATENT DOCUMENTS

EP 1753080 A1 2/2007
WO WO 2009/118565 10/2009

OTHER PUBLICATIONS

International Patent Application No. PCT/US2014/69627; Int'l Preliminary Report on Patentability; dated Dec. 11, 2015; 19 pages.
(Continued)

*Primary Examiner* — Hai V Tran
(74) *Attorney, Agent, or Firm* — Cooley LLP

(57) ABSTRACT

An antenna system is provided, including a first antenna, a second antenna, a ground plane, and a resonant isolator located proximate to the first antenna and the second antenna. The resonant isolator is coupled to the ground plane at or proximate to one current null point created by a first antenna and at or proximate to a second current null point created by a second antenna, and is configured to isolate the first antenna from the second antenna at a resonance. In some cases, the resonant isolator may include at least two conductive portions that may be substantially parallel to one another. The resonant isolator may also include an active tuning element that may change the resonance at which the resonant isolator de-couples the two antennas. In some cases, each of the antennas may be a capacitively-coupled compound loop antenna.

17 Claims, 21 Drawing Sheets

(51) Int. Cl.

| | |
|---|---|
| ***H01Q 1/38*** | (2006.01) |
| ***H01Q 5/371*** | (2015.01) |
| ***H01Q 1/24*** | (2006.01) |
| ***H01Q 1/52*** | (2006.01) |

(56) References Cited

U.S. PATENT DOCUMENTS

| | | | | |
|---|---|---|---|---|
| 6,307,509 | B1 | 10/2001 | Krantz | |
| 7,289,068 | B2 | 10/2007 | Fujio et al. | |
| 7,636,065 | B2 * | 12/2009 | Ohishi | H01Q 3/2682 343/702 |
| 8,009,119 | B2 | 8/2011 | Hung | |
| 8,144,065 | B2 | 3/2012 | Brown | |
| 8,149,173 | B2 | 4/2012 | Brown | |
| 8,164,532 | B1 | 4/2012 | Brown et al. | |
| 8,350,770 | B1 | 1/2013 | Dawson | |
| 2005/0243005 | A1 | 11/2005 | Rafi et al. | |
| 2010/0060528 | A1 | 3/2010 | Chiu et al. | |
| 2010/0156745 | A1 | 6/2010 | Andrenko et al. | |
| 2010/0171563 | A1 | 7/2010 | Dupuy et al. | |
| 2011/0018776 | A1 | 1/2011 | Brown | |
| 2012/0127038 | A1 * | 5/2012 | Kim | H01Q 1/243 343/700 MS |
| 2013/0113666 | A1 | 5/2013 | Orsi et al. | |
| 2013/0335280 | A1 | 12/2013 | Chen et al. | |

OTHER PUBLICATIONS

International Patent Application No. PCT/US2015/21113; Int'l Search Report and the Written Opinion; dated Jul. 1, 2015; 14 pages.

* cited by examiner

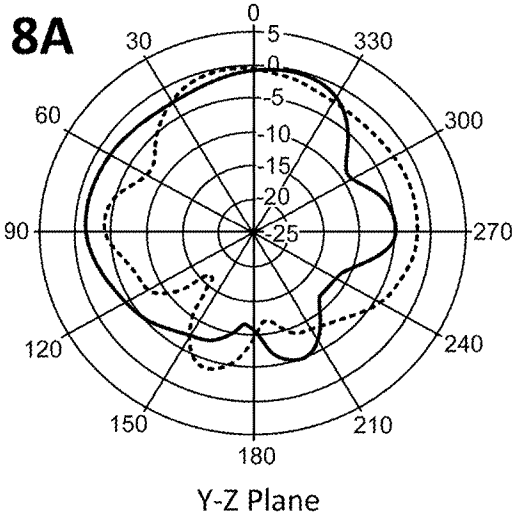
FIG. 8A
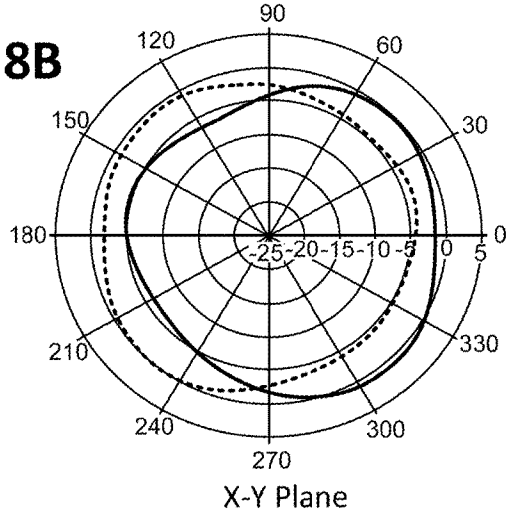
FIG. 8B
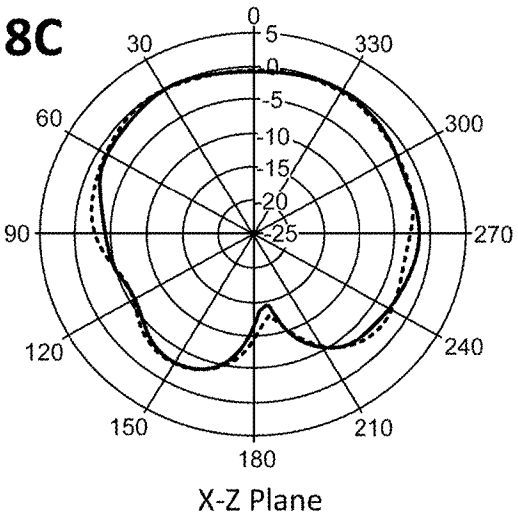
FIG. 8C
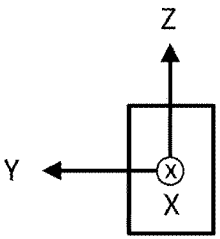

COMPOUND LOOP ANTENNA SYSTEM WITH ISOLATION FREQUENCY AGILITY

CROSS-REFERENCE TO RELATED APPLICATIONS

This application is a continuation-in-part of U.S. patent application Ser. No. 14/253,678, filed Apr. 15, 2014, now U.S. Pat. No. 9,496,614, issued Nov. 15, 2016, the contents of which incorporated herein by reference it its entirety.

TECHNICAL FIELD

The present disclosure relates to compound loop antenna, and more specifically to isolation between two or more compound loop antennas.

BACKGROUND

As new generations of cellular phones and other wireless communication devices become smaller and embedded with increased applications, new antenna designs are required to address inherent limitations of these devices and to enable new capabilities. With conventional antenna structures, a certain physical volume is required to produce a resonant antenna structure at a particular frequency and with a particular bandwidth. However, effective implementation of such antennas is often confronted with size constraints due to a limited available space in the device.

Antenna efficiency is one of the important parameters that determine the performance of the device. In particular, radiation efficiency is a metric describing how effectively the radiation occurs, and is expressed as the ratio of the radiated power to the input power of the antenna. A more efficient antenna will radiate a higher proportion of the energy fed to it. Likewise, due to the inherent reciprocity of antennas, a more efficient antenna will convert more of a received energy into electrical energy. Therefore, antennas having both good efficiency and compact size are often desired for a wide variety of applications.

Conventional loop antennas are typically current fed devices, which generate primarily a magnetic (H) field. As such, they are not typically suitable as transmitters. This is especially true of small loop antennas (i.e. those smaller than, or having a diameter less than, one wavelength). The amount of radiation energy received by a loop antenna is, in part, determined by its area. Typically, each time the area of the loop is halved, the amount of energy which may be received is reduced by approximately 3 dB. Thus, the size-efficiency tradeoff is one of the major considerations for loop antenna designs.

Voltage fed antennas, such as dipoles, radiate both electric (E) and H fields and can be used in both transmit and receive modes. Compound antennas are those in which both the transverse magnetic (TM) and transverse electric (TE) modes are excited, resulting in performance benefits such as wide bandwidth (lower Q), large radiation intensity/power/gain, and good efficiency. There are a number of examples of two dimensional, non-compound antennas, which generally include printed strips of metal on a circuit board. Most of these antennas are voltage fed. An example of one such antenna is the planar inverted F antenna (PIFA). A large number of antenna designs utilize quarter wavelength (or some multiple of a quarter wavelength), voltage fed, dipole antennas.

Use of MIMO (multiple input multiple output) technologies is increasing in today's wireless communication devices to provide enhanced data communication rates while minimizing error rates. A MIMO system is designed to mitigate interference from multipath environments by using several transmit (Tx) antennas at the same time to transmit different signals, which are not identical but are different variants of the same message, and several receive (Rx) antennas at the same time to receive the different signals. A MIMO system can generally offer significant increases in data throughput without additional bandwidth or increased transmit power by spreading the same total transmit power over the antennas so as to achieve an array gain. MIMO protocols constitute a part of wireless communication standards such as IEEE 802.11n (WiFi), 4G, Long Term Evolution (LTE), WiMAX and HSPA+. However, in a configuration with multiple antennas, size constraints tend to become severe, and interference effects caused by electromagnetic coupling among the antennas may significantly deteriorate transmission and reception qualities. At the same time, efficiency may deteriorate in many instances where multiple paths are energized and power consumption increases.

SUMMARY

An antenna system is provided, including a first antenna, a second antenna, a ground plane, and a resonant isolator located proximate to the first antenna and the second antenna. The resonant isolator is coupled to the ground plane at or proximate to at least one current null point created by at least one of the first antenna or the second antenna, and is configured to isolate the first antenna from the second antenna at a resonance. In some cases, the resonant isolator may include at least two conductive portions that may be substantially parallel to one another. The resonant isolator may also include an active tuning element that may change the resonance at which the resonant isolator de-couples the two antennas. In some cases, each of the antennas may be a compound loop antenna.

BRIEF DESCRIPTION OF THE DRAWINGS

FIG. 3A illustrates the top view of a first layer including Antenna 1, Antenna 2 and a first ground plane, and FIG. 3B illustrates the bottom view of a second layer including a second ground plane.

FIG. 4A illustrates the top view of a first layer including Antenna 1, Antenna 2 and a first ground plane, and FIG. 4B illustrates the bottom view of a second layer including a second ground plane and the resonant isolator.

FIGS. 8A, 8B and 8C are plots illustrating measured radiation patterns at 2.45 GHz, on the Y-Z plane, the X-Y plane and the X-Z plane, respectively.

DETAILED DESCRIPTION OF ILLUSTRATIVE EMBODIMENTS

In view of known limitations associated with conventional antennas, in particular with regard to radiation efficiency, a compound loop antenna (CPL), also referred to as a modified loop antenna, has been devised to provide both transmit and receive modes with greater efficiency than a conventional antenna with a comparable size. Examples of structures and implementations of the CPL antennas are described in U.S. Pat. No. 8,144,065, issued on Mar. 27, 2012, U.S. Pat. No. 8,149,173, issued on Apr. 3, 2012, and U.S. Pat. No. 8,164,532, issued on Apr. 24, 2012. Key features of the CPL antennas are summarized below with reference to the example illustrated in FIG. 1.

Figure 1:
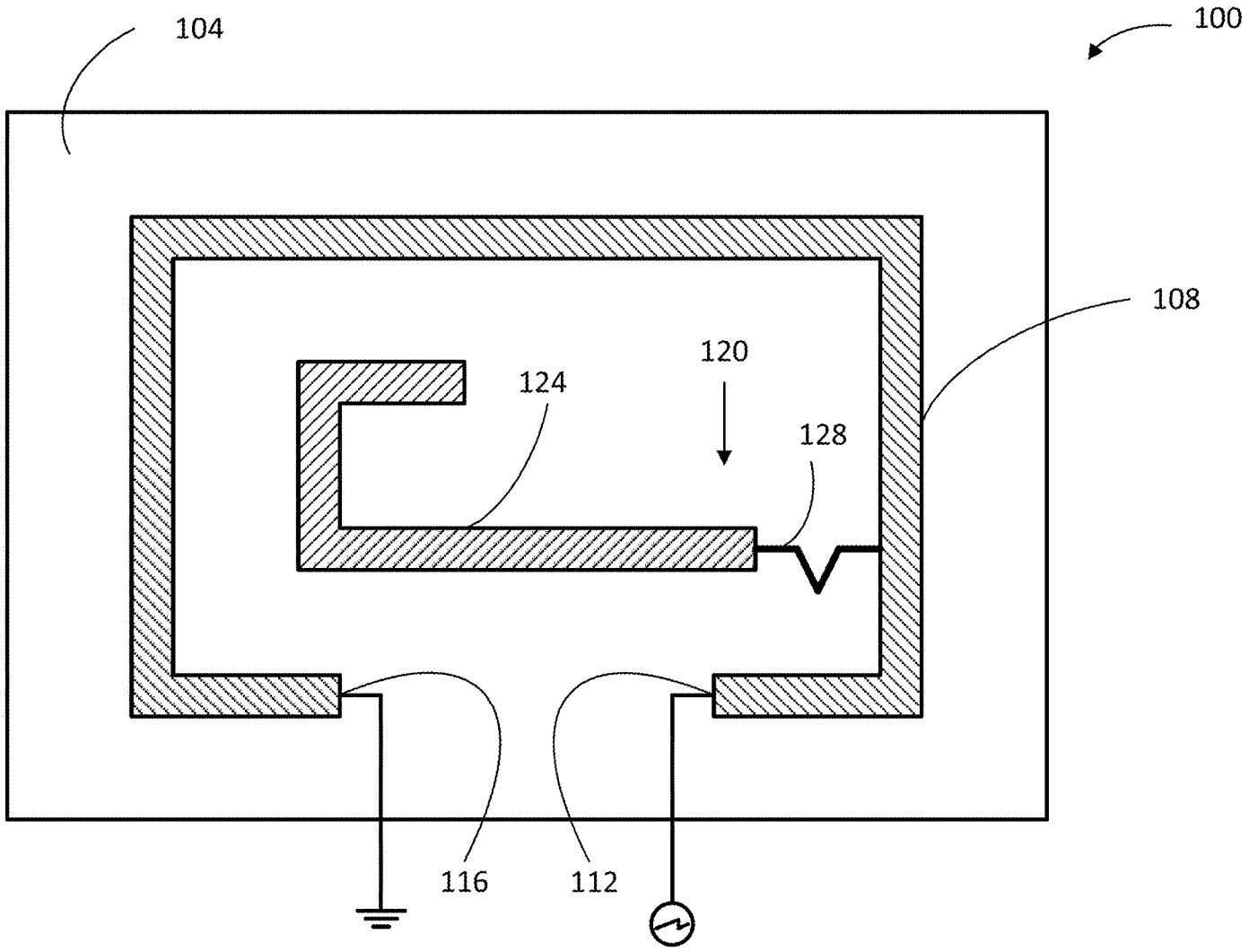
FIG. 1 illustrates an example of a planar CPL antenna.

FIG. 1 illustrates an example of a planar CPL antenna 100. In this example, the planar CPL antenna 100 is printed on a printed circuit board (PCB) 104, and includes a loop element 108, which in this case is formed as a trace along rectangle edges with an open base portion providing two end portions 112 and 116. One end portion 112 is a feed point of the antenna where the current is fed. The other end portion 116 is shorted to ground. The CPL antenna 100 further includes a radiating element 120 that has a J-shaped trace 124 and a meander trace 128. In this example, the meander trace 128 is configured to couple the J-shaped trace 124 to the loop element 108. The radiating element 120 essentially functions as a series resonant circuit providing an inductance and a capacitance in series, and their values are chosen such that the resonance occurs at the frequency of operation of the antenna. Instead of using the meander trace 128, the shape and dimensions of the J-shaped trace 124 may be adjusted to connect directly to the loop element 108 and still provide the target resonance.

Similar to a conventional loop antenna that is typically current fed, the loop element 108 of the planar CPL antenna 100 generates a magnetic (H) field. The radiating element 120, having the series resonant circuit characteristics, effectively operates as an electric (E) field radiator (which of course is an E field receiver as well due to the reciprocity inherent in antennas). The connection point of the radiating element 120 to the loop element 108 is critical in the planar CPL antenna 100 for generating/receiving the E and H fields that are substantially orthogonal to each other. This orthogonal relationship has the effect of enabling the electromagnetic waves emitted by the antenna to effectively propagate through space. In the absence of the E and H fields arranged orthogonal to each other, the waves will not propagate effectively beyond short distances. To achieve this effect, the radiating element 120 is placed at a position where the E field produced by the radiating element 120 is 90° or 270° out of phase relative to the H field produced by the loop element 108. Specifically, the radiating element 120 is placed at the substantially 90° (or 270°) electrical length along the loop element 108 from the feed point 112. Alternatively, the radiating element 120 may be connected to a location of the loop element 108 where current flowing through the loop element 108 is at a reflective minimum.

In addition to the orthogonality of the E and H fields, it is desirable that the E and H fields are comparable to each other in magnitude. These two factors, i.e., orthogonality and comparable magnitudes, may be appreciated by looking at the Poynting vector (vector power density) defined by P=E×H (Volts/m×Amperes/m=Watts/m2). The total radiated power leaving a surface surrounding the antenna is found by integrating the Poynting vector over the surface. Accordingly, the quantity E×H is a direct measure of the radiated power, and thus the radiation efficiency. First, it is noted that when the E and H are orthogonal to each other, the vector product gives the maximum. Second, since the overall magnitude of a product of two quantities is limited by the smaller, having the two quantities (|H| and |E| in this case) as close as possible will give the optimal product value. As explained above, in the planar CPL antenna, the orthogonally is achieved by placing the radiating element 120 at the substantially 90° (or 270°) electrical length along the loop element 108 from the feed point 112. Furthermore, the shapes and dimensions of the loop element 108 and the radiating element 120 can be each configured to provide comparable, high |H| and |E| in magnitude, respectively. Therefore, in marked contrast to a conventional loop antenna, the planar CPL antenna can be configured not only to provide both transmit and receive modes, but also to increase the radiation efficiency.

Size reduction can be achieved by introducing a series capacitance in the loop element and/or the radiating element of the CPL antenna. Such an antenna structure, referred to as a capacitively-coupled compound loop antenna (C2CPL), has been devised to provide both transmit and receive modes with greater efficiency and smaller size than a conventional antenna. Examples of structures and implementations of the C2CPL antennas are described in U.S. patent application Ser. No. 13/669,389, entitled "Capacitively Coupled Compound Loop Antenna," filed Nov. 5, 2012. Key features of C2CPL antennas are summarized below with reference to the example illustrated in FIG. 2.

Figure 2:
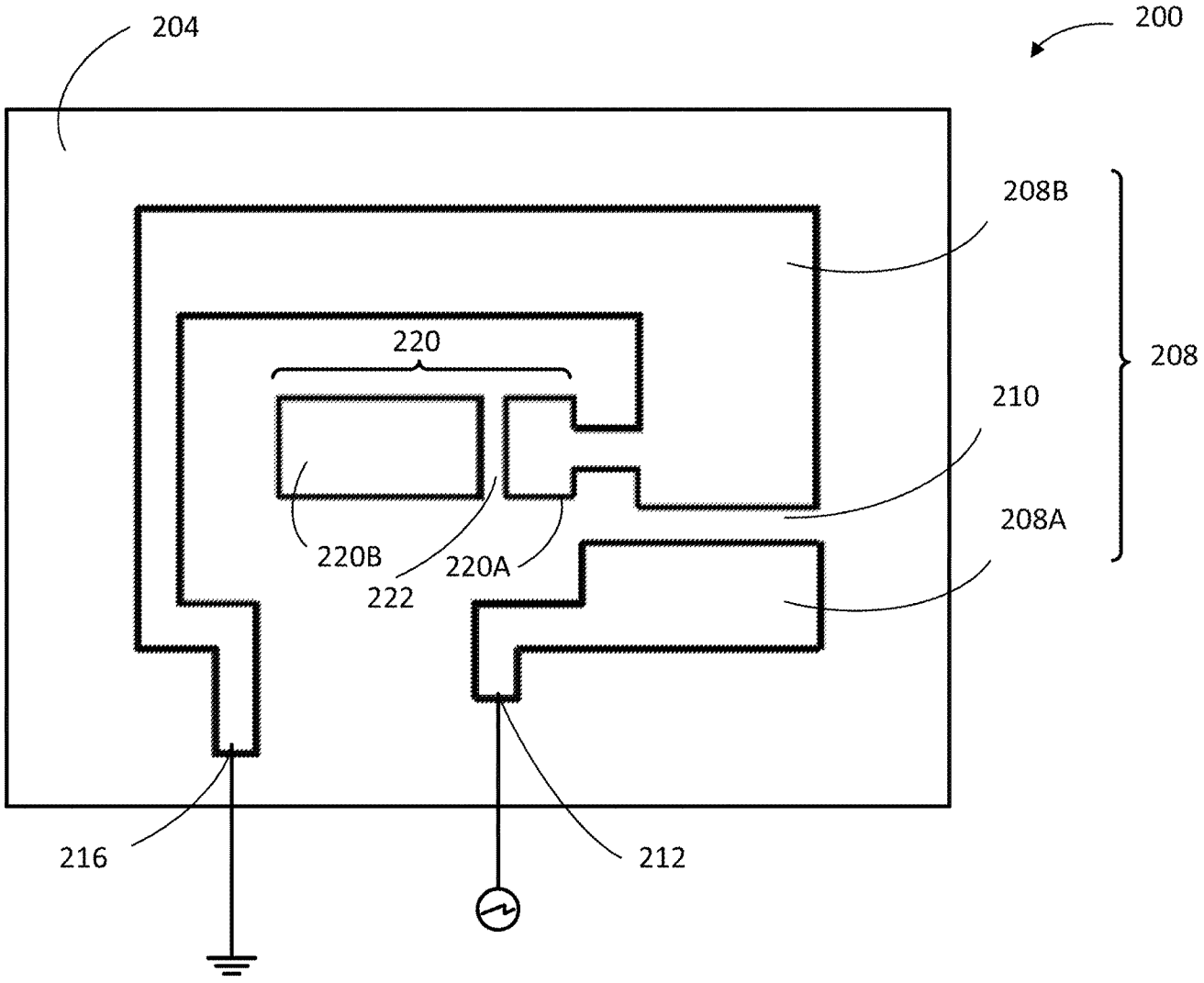
FIG. 2 illustrates an example of a planar C2CPL antenna.

FIG. 2 illustrates an example of a planar C2CPL antenna 200. In this example, the planar C2CPL antenna 200 is printed on a printed circuit board (PCB) 204, and includes a loop element 208 having a first loop section 208A and a second loop section 208B, which are capacitively coupled through a gap 210. Therefore, in the case of the C2CPL, the loop element 208 may be considered to be a first element including the two conductive sections 208A and 208B and the capacitive gap 210. The capacitance value can be adjusted by adjusting the width and the length of the gap 210. An end portion 212, which is opposite to the capacitively coupled edge of the first loop section 208A, is a current feed point of the antenna. Another end portion 216, which is opposite to the capacitively coupled edge of the second loop section 208B, is shorted to ground. The C2CPL antenna 200 further includes a radiating element 220, which is a second element, coupled to the loop element 208. Similar to the CPL antenna, the connection point of the radiating element 220 to the loop element 208 is critical in the C2CPL antenna 200 for generating/receiving the E and H fields that are substantially orthogonal to each other. To achieve this effect, the radiating element 220 is placed at the substantially 90° (or 270°) electrical length along the loop element 208 from the feed point 212. The shape and dimensions of each element of the antenna structure can be adjusted to obtain target resonances. For example, the antenna structure of FIG. 2 can be adjusted to have the 2.4/5.8 GHz dual band for certain wireless applications. In the present example illustrated in FIG. 2, the gap 210 is introduced in the loop element 208. Alternatively or additionally, a gap may be introduced in the radiating element 220 to achieve size reduction. Namely, a gap may be introduced in the first element and/or the second element, and the separate sections are configured to be capacitively coupled for the size reduction purpose.

Figure 3A:
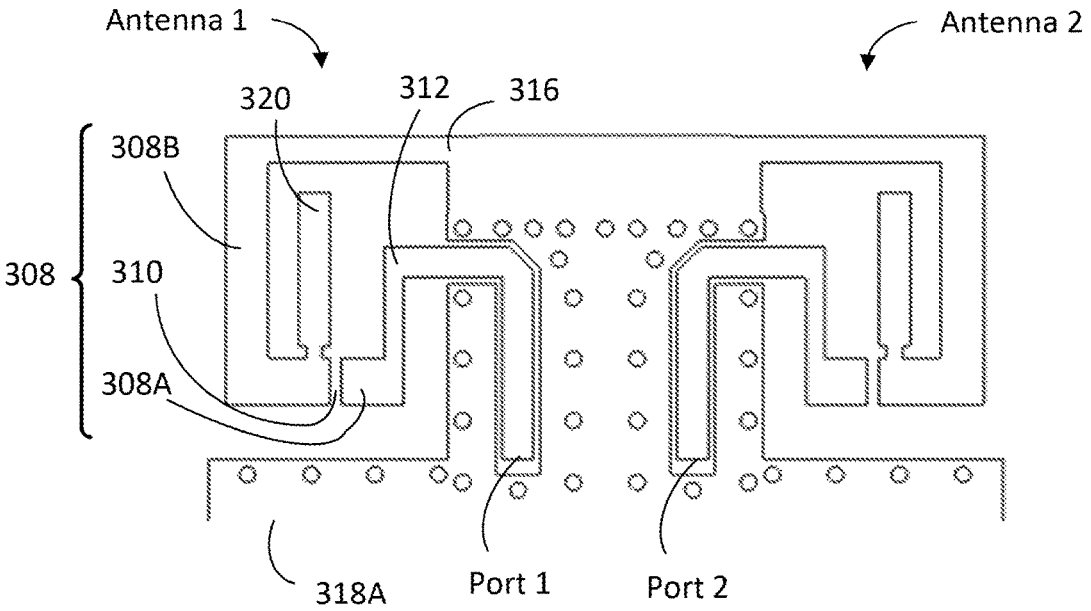
FIGS. 3A and 3B illustrate a two-antenna system having two C2CPL antennas, where
Figure 3B:
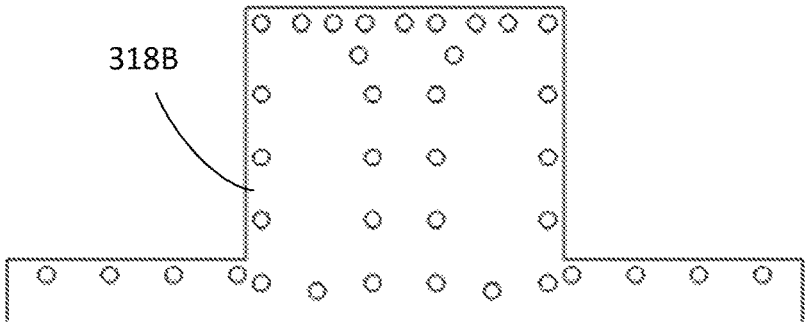

As explained above, the C2CPL antennas are capable of achieving high efficiency with reduced size; thus, these antennas are good candidates to be used for a multiple antenna system such as a MIMO system, a USB dongle, etc. FIGS. 3A and 3B illustrate a two-antenna system having two C2CPL antennas similar to the example illustrated in FIG. 2. Conductive parts of the antenna structures and ground planes may be printed on a dielectric substrate such as a PCB, ceramic, alumina, etc. Alternatively, these parts may be formed with air gaps or styrofoam in between the parts. FIG. 3A illustrates the top view of a first layer including Antenna 1, Antenna 2 and a first ground plane 318A. FIG. 3B illustrates the bottom view of a second layer including a second ground plane 318B. The first and second ground planes 318A and 318B are coupled by ground vias formed vertical to and between the first and second ground planes 318A and 318B (the ground vias are indicated with multiple small circles in the figures) so as to have an equal potential.

In this example of FIGS. 3A and 3B, Antenna 1 is a planar C2CPL antenna having a structure similar to the one illustrated in FIG. 2, and includes a loop element 308, of a first layer, having a first loop section 308A and a second loop section 308B, which are capacitively coupled through a gap 310. Therefore, the loop element 308 in the C2CPL antenna may be considered to be a first element including the two conductive sections 308A and 308B and the capacitive gap 310. A first end point 312, which is opposite to the capacitively coupled edge of the first loop section 308A, is a current feed point of Antenna 1. The feed point 312 is coupled to Port 1, which is formed in, but separated from, the first ground plane 318A, in this example, of the first layer. A second end point 316, which is opposite to the capacitively coupled edge of the second loop section 308B, is shorted to the first ground plane 318A. Antenna 1 further includes a radiating element 320, which is a second element, coupled to the loop element 308. For generating/receiving the E and H fields that are substantially orthogonal to each other, the radiating element 320 is placed at the substantially 90° (or 270°) electrical length along the loop element 308 from the feed point 312. In the present example, the gap 310 is introduced in the loop element 308. Alternatively or additionally, a gap may be introduced in the radiating element 320 to achieve size reduction. Namely, a gap may be introduced in the first element and/or the second element, and the separate sections are configured to be capacitively coupled for the size reduction purpose.

As illustrated in FIG. 3A, the second antenna, Antenna 2, is essentially a mirror image of the first antenna, Antenna 1. As illustrated, Antenna 2 is coupled to Port 2 to be current-fed independently from Antenna 1. Port 2 also is formed in, but separated from, the first ground plane 318A. In the present example, Antenna 1 and Antenna 2 are illustrated to have the same structure and to be placed symmetrically. However, differently shaped C2CPL antennas can be used, and the placement does not have to be symmetric in order to form the two-antenna system. The shape and dimensions of each element of Antenna 1 and Antenna 2 can be varied depending on target resonances. Furthermore, three or more C2CPL antennas may be used to form a multi-antenna system.

As mentioned earlier, in a configuration where multiple antennas are closely packed, interference effects caused by electromagnetic coupling among the antennas may significantly deteriorate transmission and reception qualities and efficiency. Therefore, an antenna isolation scheme is often needed for a multi-antenna system. This document describes implementations of a resonant isolator configured to couple two antennas in the system to achieve electromagnetic isolation of the antennas at resonance.

Figure 4A:
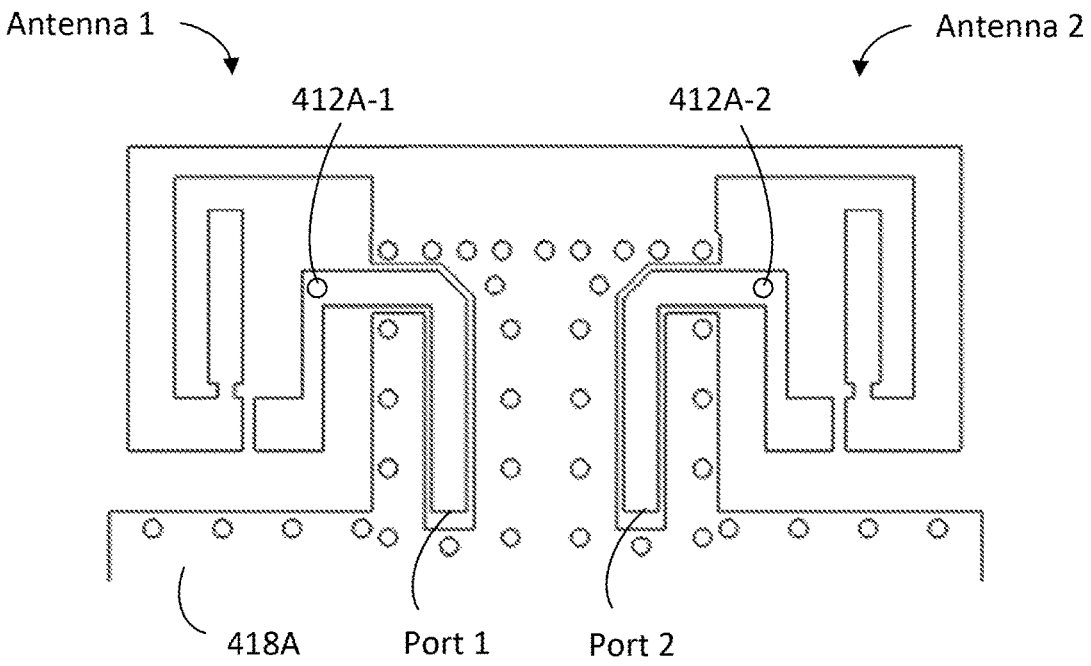
FIGS. 4A and 4B illustrate an example of a two-antenna system having two C2CPL antennas with a resonant isolator de-coupling the two antennas, where
Figure 4B:
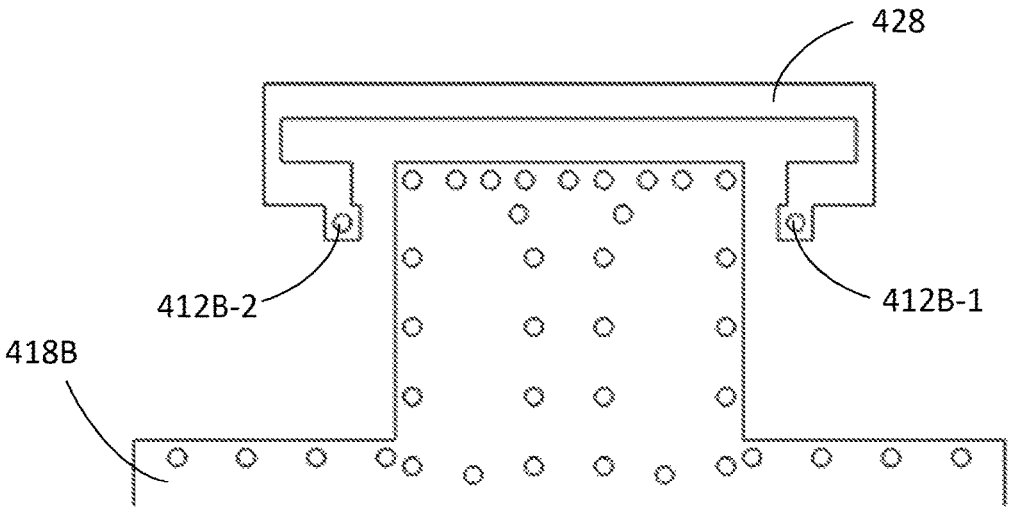

FIGS. 4A and 4B illustrate an example of the two C2CPL antenna system illustrated in FIGS. 3A and 3B where a resonant isolator is further included to de-couple the two antennas and electromagnetically isolate the two antennas at resonance. Conductive parts of the two-antenna structure and ground planes may be printed on a dielectric substrate such as a PCB, ceramic, alumina, etc. Alternatively, these parts may be formed with air gaps or styrofoam in between the parts. FIG. 4A illustrates the top view of a first layer including Antenna 1, Antenna 2 and a first ground plane 418A. FIG. 4B illustrates the bottom view of a second layer including a second ground plane 418B and a resonant isolator 428. The two ground planes are coupled with ground vias, indicated with multiple circles, to keep them at an equal potential.

In the example of FIGS. 4A and 4B, Antenna 1 is a planar C2CPL antenna having a structure similar to the one illustrated in FIG. 3A. A feed point 412A-1 is coupled to Port 1, which is formed in, but separated from, the first ground plane 418A in this example. A feed point 412A-2 of the second antenna, Antenna 2, is coupled to Port 2 to be fed independently from Antenna 1. Port 2 also is formed in, but separated from, the first ground plane. In the present example, Antenna 1 and Antenna 2 are illustrated to have the same C2CPL antenna structure and be placed symmetrically. However, different C2CPL antennas can be used, and the placement does not have to be symmetric to form the two-antenna system. The shape and dimensions of each element of Antenna 1 and Antenna 2, as well as of the resonant isolator 428, can be varied depending on target resonances.

The first and second end portions, labeled 412B-1 and 412B-2, of the resonant isolator 428 are coupled to the feed points 412A-1 and 412A-2 of Antenna 1 and Antenna 2, respectively. Vertical vias are formed in the first and second layers between points 412A-1/412B-1 and 412A-2/412B-2, with the first via coupling the first end portion 412B-1 of the resonant isolator 428 to the feed point 412A-1 of Antenna 1, and the second via coupling the second end portion 412B-2 of the resonant isolator 428 to the feed point 412A-2 of Antenna 2. The location of the resonant isolator 428 in the second layer is predetermined so as to overlap with the foot print of the first ground plane 418A formed in the first layer. In other words, the first ground plane 418A is configured to overhang the resonant isolator 428. This configuration allows for better frequency tuning than may otherwise be obtainable.

According to an embodiment, the first and second end portions, 412B-1 and 412B-2 of the resonant isolator 428 are coupled to the feed points 412A-1 and 412A-2 of Antenna 1 and Antenna 2, respectively, which is at a point where the current has a maximum value in each antenna. Furthermore, the electrical length of the resonant isolator 428 is configured to be substantially 90° or its odd multiples (270°, 450°, etc.). This configuration provides optimal isolation between the two antennas.

Furthermore, the reflected wave associated with the resonant current on the resonant isolator 428 undergoes a 180° phase shift with respect to the forward wave, since the electrical length of the resonant isolator is set to be 90°. Therefore, the forward wave and the reflected wave, which have the 180° phase offset, are combined to effectively generate an open circuit with respect to the node of the current course, which represents Antenna 1. As such, Antenna 1 and Antenna 2 can be substantially isolated at resonance due to the presence of the resonant isolator 428 that has the electrical length of 90°.

Figure 5A:
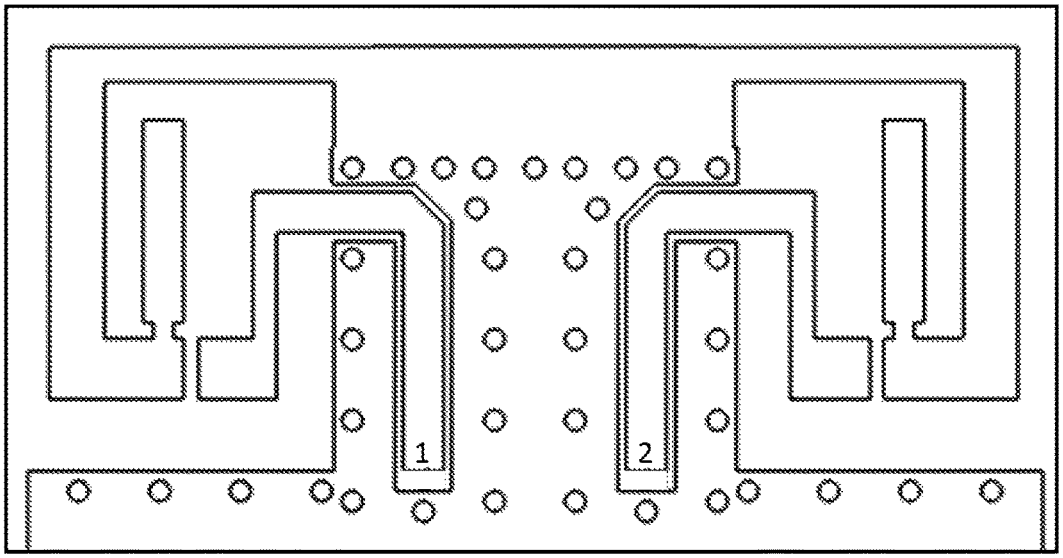
FIGS. 5A and 5B illustrate an implementation example of a device having the two-antenna system including two C2CPL antennas de-coupled by the resonant isolator, where the top view and the bottom view of the device are illustrated in FIGS. 5A and 5B, respectively.
Figure 5B:
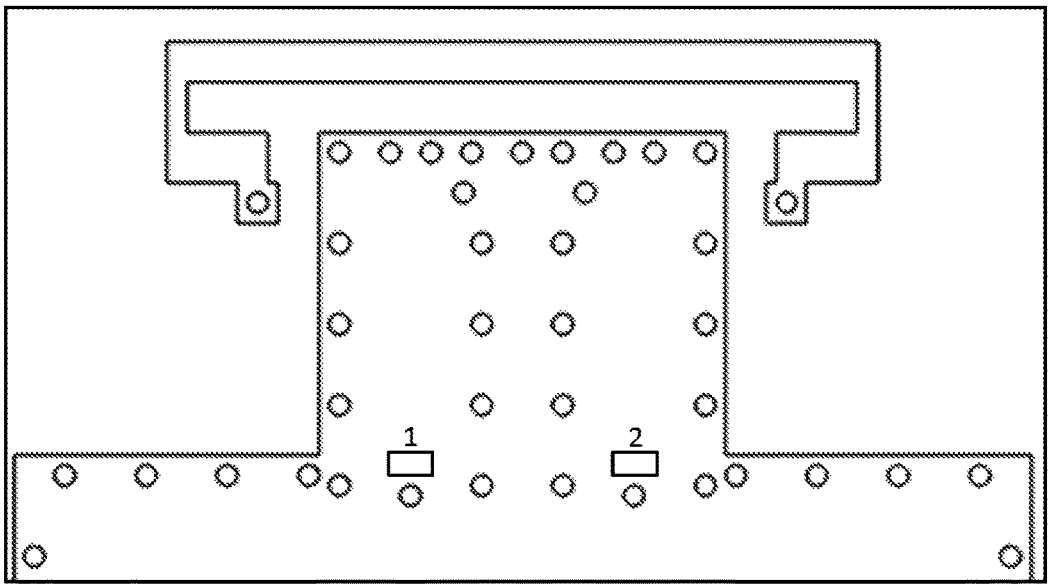

As explained in the foregoing, the two-antenna system according to an embodiment includes two C2CPL antennas de-coupled by the resonant isolator having an electrical length of substantially 90° (or its odd multiple), wherein efficiency is enhanced due to the generation of substantially orthogonal E and H fields, size reduction is achieved by configuring the capacitively coupled antenna elements, and isolation between the two antennas at resonance is enhanced due to the resonant isolator de-coupling the two antennas. FIGS. 5A and 5B illustrate an implementation example of a device having the two-antenna system including two C2CPL antennas de-coupled by the resonant isolator, as illustrated in FIGS. 4A and 4B. The top view and the bottom view of the device are illustrated in FIGS. 5A and 5B, respectively, by showing the outlines of the structure formed on the first and second layers together. The size and dimensions of each element is adjusted to obtain the 2.4 GHz band in the example provided in FIGS. 5A and 5B, but multiband implementations may be possible as well.

Figure 6:
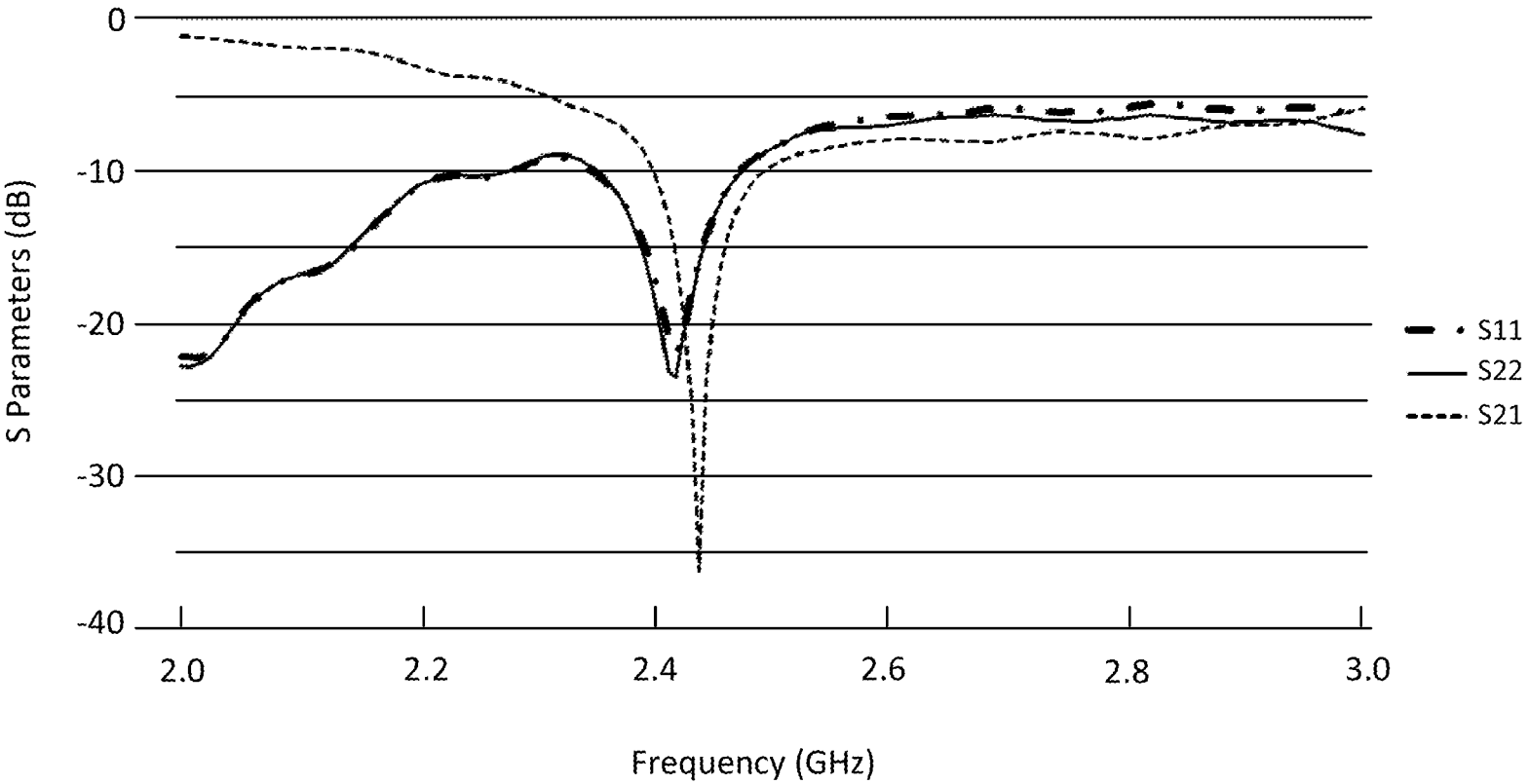
FIG. 6 is a plot illustrating measured S parameters versus frequency.

FIG. 6 is a plot illustrating measured S parameters versus frequency for the device illustrated in FIGS. 5A and 5B, where three S parameters are plotted separately. High isolation is achieved near the 2.4 GHz resonance as indicated by the S21 parameter value in this plot. It can be seen that this two-antenna system with the resonant isolator has low-pass filter characteristics exhibiting high RF transmission at low frequencies due to the strong coupling between the two antennas in this region.

Figure 7:
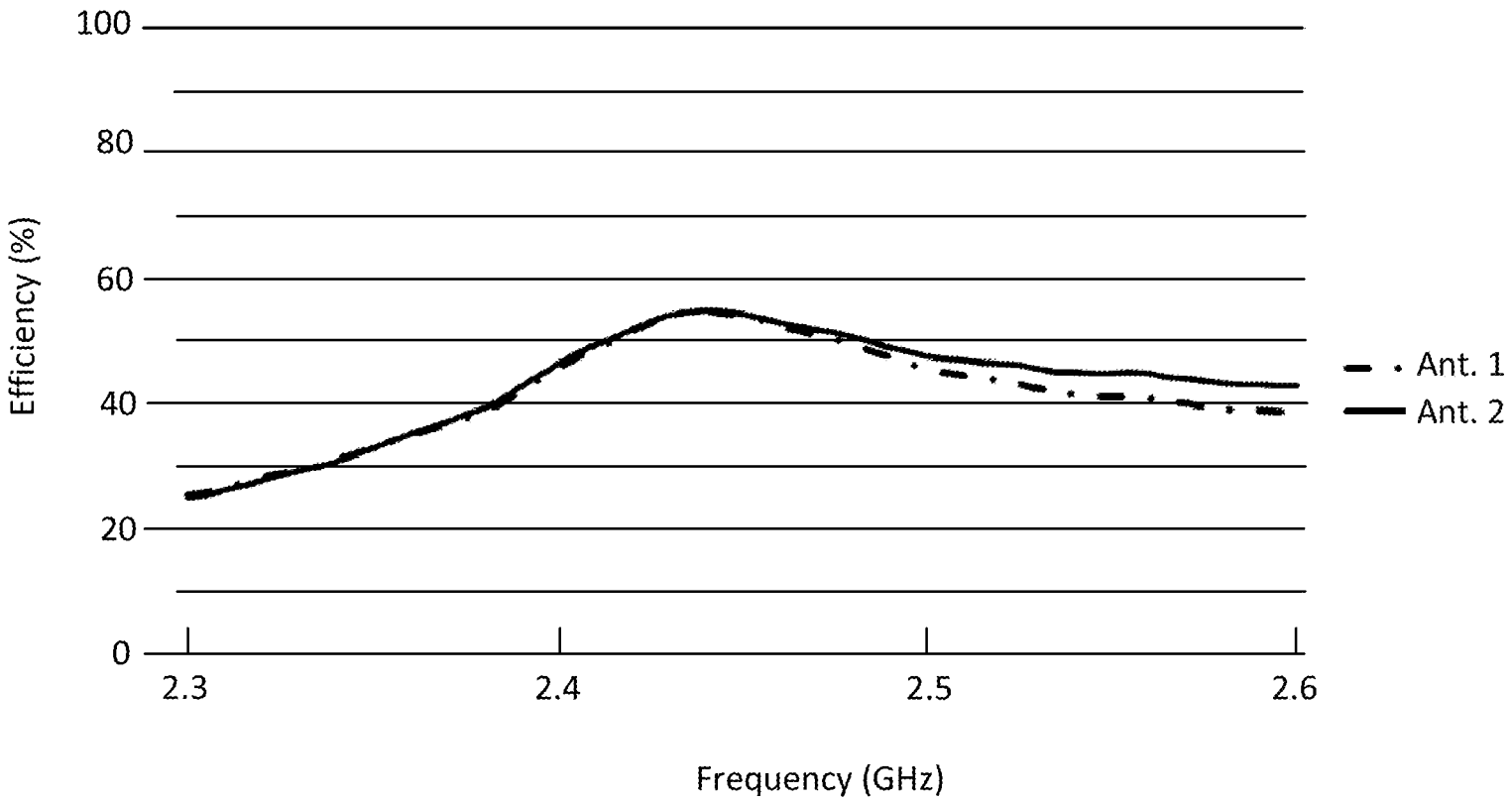
FIG. 7 is a plot illustrating measured efficiency versus frequency.

FIG. 7 is a plot illustrating measured efficiency versus frequency for the device illustrated in FIGS. 5A and 5B, where the efficiency of Antenna 1 and the efficiency of Antenna 2 are plotted separately. The efficiency value near 50% is achieved in the proximity of the 2.4 GHz resonance, in spite of the small device size afforded by the use of C2CPL antennas.

FIGS. 8A, 8B and 8C are plots illustrating measured radiation patterns at 2.45 GHz, on the Y-Z plane, the X-Y plane and the X-Z plane, respectively, for the device illustrated in FIGS. 5A and 5B, where the radiation pattern of Antenna 1 and the radiation pattern of Antenna 2 are plotted separately in each figure. The X, Y and Z axes are assigned with respect to the device placed along the Y-Z plane, as indicated in the inset. As seen from FIGS. 8A and 8B, the radiation patterns of Antenna 1 and Antenna 2 are generated complementary to each other, due to the high isolation between the two antennas. The radiation patterns on the X-Z plane in FIG. 8C show that most of the electromagnetic energy is in the upper hemisphere, with relatively small energy going downward. This is a desirable characteristic when the device is used as a USB dongle to be inserted to a PC, for example. In this configuration, the radiation patterns going downward are minimal, and thus electromagnetic interference to the electronics in the PC is minimal.

The present disclosure includes just one example of a two C2CPL antenna structure and an embodiment of a resonant isolator. However, any C2CPL antennas, such as those described in the aforementioned U.S. patent application Ser. No. 13/669,389, as well as their variations, may be used to obtain a highly efficient and isolated two-antenna system with small size. It should also be noted that it is also possible to expand the use of the resonant isolator to N antenna systems. Hence, the present disclosure is not limited to only two C2CPL antennas nor is the present disclosure limited to only CPL antennas and could likewise be used with a wide variety of other antennas. In addition, while the resonant isolator for isolating the two antennas is configured for one particular resonance in the above examples, it is possible to reconfigure the resonant isolator to provide isolation at two or more resonances for a multi-band system.

Figure 9:
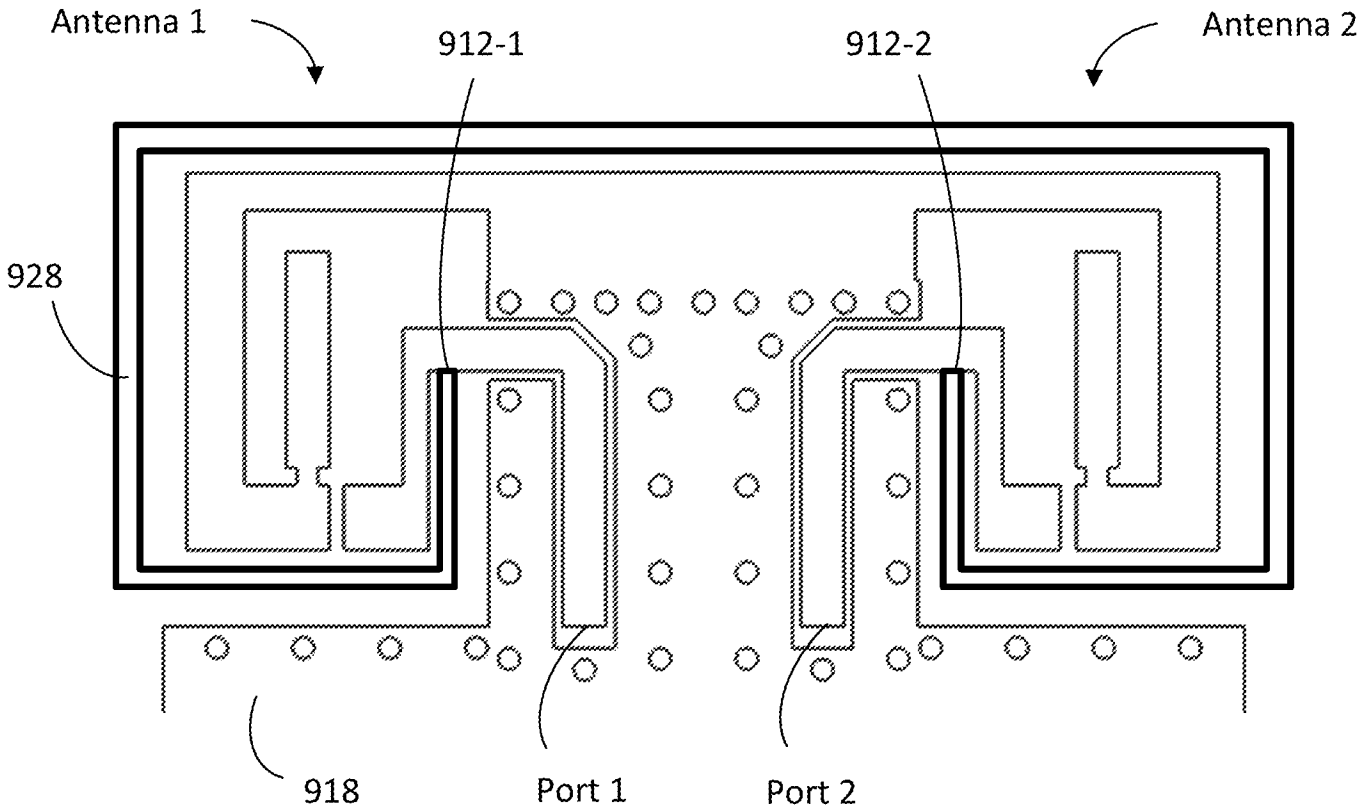
FIG. 9 illustrates another example of a two-antenna system having two C2CPL with a resonant isolator decoupling the two antennas, where illustrated is the top view of the first layer including Antenna 1, Antenna 2, a first ground plane and the resonant isolator.

FIG. 9 illustrates another example of a two-antenna system having two C2CPL antennas similar to the example illustrated in FIG. 2, where a resonant isolator is included to de-couple the two antennas and electromagnetically isolate the two antennas at resonance. The structure of this antenna system is similar to the example illustrated in FIGS. 4A and 4B, except that the resonant isolator 928 is placed in the first layer instead of the second layer. FIG. 9 illustrates the top view of the first layer including Antenna 1, Antenna 2, a first ground plane 918 and the resonant isolator 928. A second ground plane may be formed on the second layer which is on the substrate surface opposite to the surface where the first layer is formed. The two ground planes may be coupled with ground vias to keep them at an equal potential. Alternatively, the present antenna system may be configured to have a single layer accommodating all the elements without having the second ground plane in the second layer. Each of Antenna 1 and Antenna 2 is a planar C2CPL antenna having a structure similar to the one illustrated in FIG. 2. A feed point of Antenna 1 is coupled to Port 1; and a feed point of Antenna 2 is coupled to Port 2 to be current-fed independently from Antenna 1. In the present example, Antenna 1 and Antenna 2 are illustrated to have the same C2CPL antenna structure and to be placed mirror symmetrically. However, different C2CPL antennas can be used, and the placement does not have to be mirror symmetric to form the two-antenna system. The shape and dimensions of each element of Antenna 1 and Antenna 2, as well as of the resonant isolator 1028, can be varied depending on target resonances.

The first and second end portions 912-1 and 912-2 of the resonant isolator 1028 are coupled to the locations near the feed points of Antenna 1 and Antenna 2, respectively, where the current has the maximum value in each antenna. Furthermore, the electrical length of the resonant isolator 928 is configured to be substantially 90° or its odd multiples (270°, 450°, etc.).

Figure 10B:
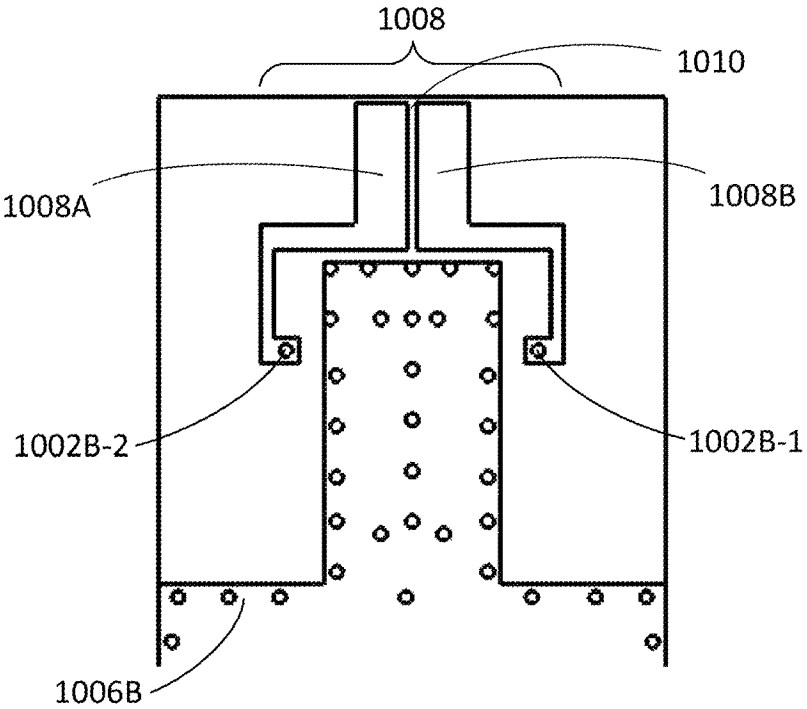
FIGS. 10A and 10B illustrate a top view and a bottom view, respectively, of an example of a two-antenna system with a capacitively coupled resonant isolator.
Figure 10A:
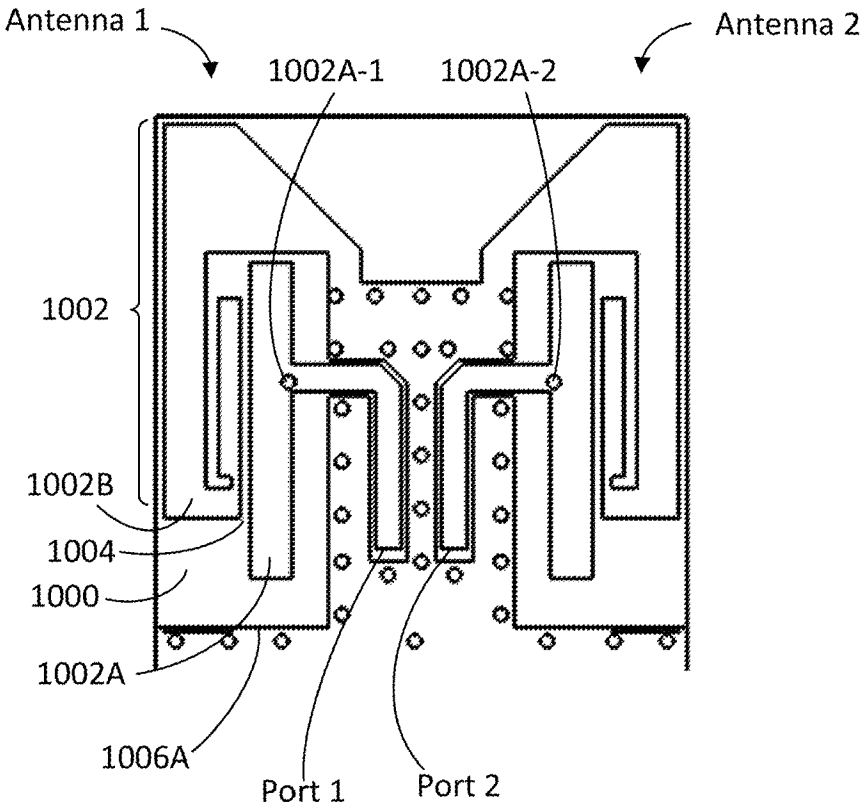

In the examples provided above, the two-antenna system operates at a single frequency and the resonant isolator is a contiguous conductive element. The example of a two-antenna system illustrated in FIGS. 10A and 10B shows a top view and a bottom view, respectively, of a multi-band, two-antenna system mounted on a dielectric substrate 1000, where the resonant isolator is formed by two separate conductive elements that are capacitively coupled. Antennas 1 and 2 are planar C2CPL antennas having a different structure from that previously illustrated. Antennas 1 and 2 include a loop element 1002 having a first loop section 1002A and a second loop section 1002B, which are capacitively coupled through a gap 1004. Therefore, the loop element 1002 in each of the C2CPL antennas may be considered to be a first element including the two conductive sections 1002A and 1002B and the capacitive gap 1004. The first loop section 1002A of Antenna 1 is powered at a first end portion and current feed point 1002A-1 of Antenna 1, while the first loop section 1002A of Antenna 2 is powered at a first end portion and current feed point 1002A-2 of Antenna 2. Each of the feed points 1002A-1 and 1002A-2 are coupled to Port 1 and Port 2, respectively. Ports 1 and 2 are formed in, but are separated from, the first ground plane 1006A.

The other end portions of Antennas 1 and 2, which are each opposite to the capacitively coupled edge of the second loop section 1002B, are shorted to the first ground plane 1006A. Antennas 1 and 2 further include two radiating elements, each operating at a different frequency, that are formed in each of the loop sections 1002A and 1002B. For generating/receiving the E and H fields of Antenna 1, which are substantially orthogonal to each other, the radiating element of the second loop section 1002B is placed at the substantially 90° (or 270°) electrical length along the loop element 1002B from the feed point 1002A-1. The same configuration is followed in Antenna 2. The gap 1004 may be configured for size reduction purposes as discussed above. FIG. 10B illustrates the bottom view including a second ground plane 1006B and a resonant isolator 1008 formed of first part 1008A and second part 1008B separated by a gap 1010. The two ground planes are coupled with ground vias, not shown in FIGS. 10A and 10B, but indicated with multiple circles as illustrated in some of the other FIGS. above, to keep them at an equal potential. While the antenna arrangement illustrated in FIGS. 10A and 10B are mirror symmetric, no symmetry is essential and different shaped and configured antennas could be used as part of the two-antenna system.

The implementation of a capacitive loaded resonant isolator as illustrated in FIG. 10B may significantly improve isolation between two closely packed antennas that are separated by less than the operating wavelength of the antennas. Furthermore, the present example allows for area re-use within the C2CPL antenna artwork for the purpose of supporting dual band operation with enhanced isolation in both bands. The resonant isolator for each antenna may be connected to the feed point of the antenna near a low local impedance point (i.e., local current maximum). The total length of the capacitive loaded resonant isolator may be such that the current flowing on its structure undergoes a phase change that additively cancels with the current excited on the non-active portions of antenna at the shared connection points 1002B-1 and 1002B-2. The introduction of a capacitive element in the resonant isolator artwork simultaneously allows for increased miniaturization and dual band operation.

Figure 11:
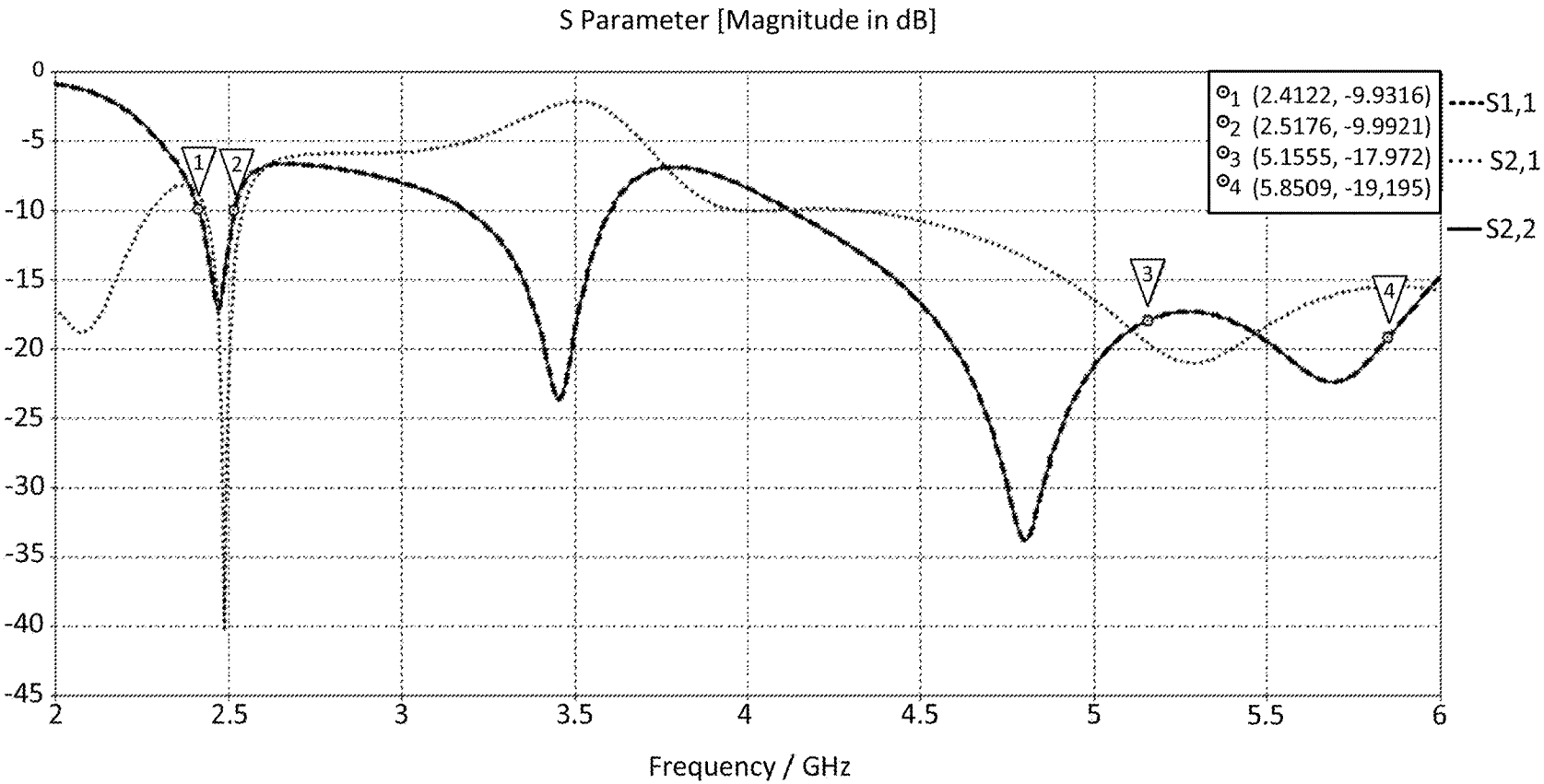
FIG. 11 is a plot illustrating measured S parameters vs. frequency for the example illustrated in FIGS. 10A and 10B at both operating frequencies.

FIG. 11 is a plot illustrating measured S parameters vs. frequency for the example illustrated in FIGS. 10A and 10B at both operating frequencies, where two S parameters are plotted separately. High isolation is achieved near the 2.4 GHz resonance as indicated by the S2,1 parameter value in this plot, and less so at 5.5 GHz as indicated by the S2,2 parameter.

Figure 12C:
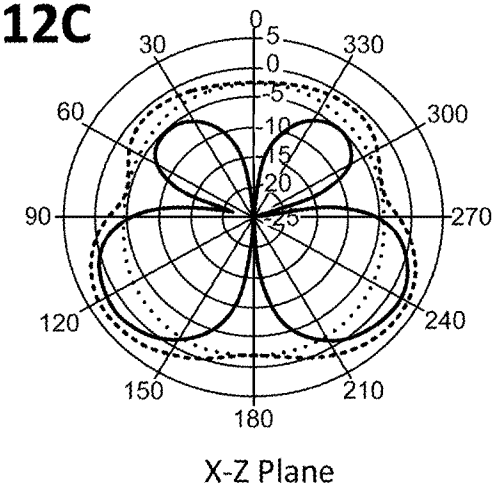
FIGS. 12A, 12B and 12C are plots illustrating measured radiation patterns for the example illustrated in FIGS. 10A and 10B at 2.45 GHz, on the Y-Z plane, the X-Y plane and the X-Z plane, respectively.
Figure 12A:
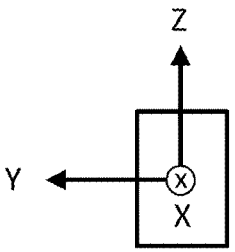
Figure 12A:
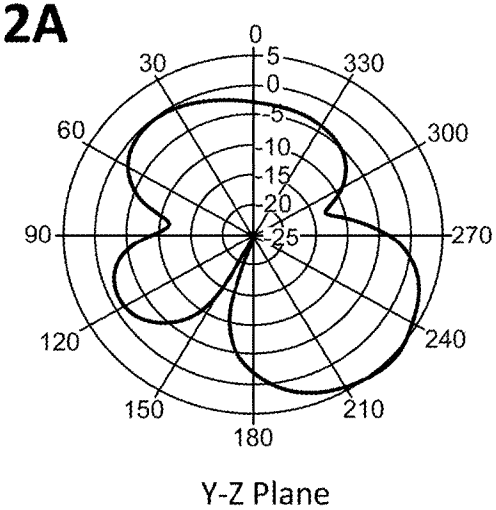
Figure 12B:
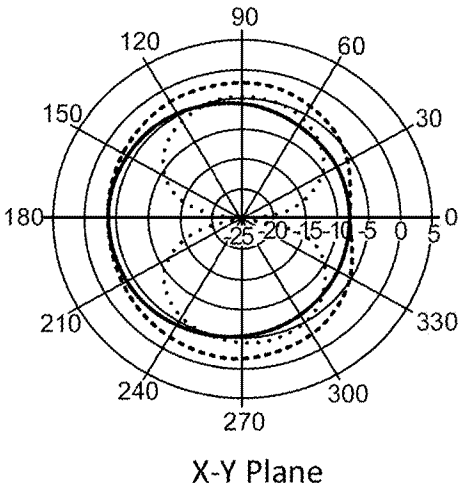
Figure 13A:
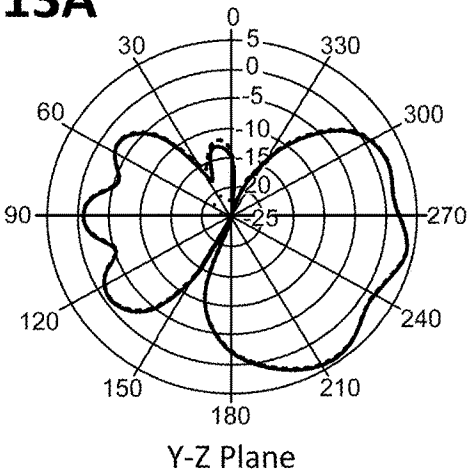
FIGS. 13A, 13B and 13C are plots illustrating measured radiation patterns for the example illustrated in FIGS. 10A and 10B at 5.5 GHz, on the Y-Z plane, the X-Y plane and the X-Z plane, respectively.
Figure 13B:
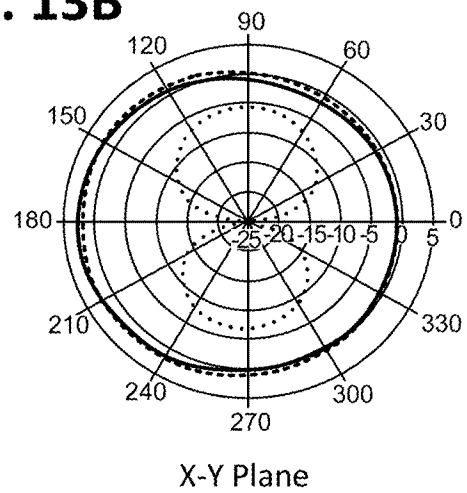
Figure 13C:
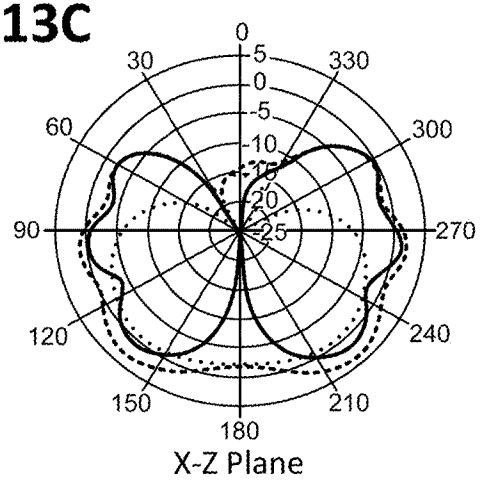
Figure 13C:
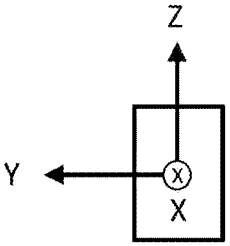

FIGS. 12A, 12B and 12C are plots illustrating measured radiation patterns for the example illustrated in FIGS. 10A and 10B at 2.45 GHz, on the Y-Z plane, the X-Y plane and the X-Z plane, respectively. FIGS. 13A, 13B and 13C are plots illustrating measured radiation patterns for the example illustrated in FIGS. 10A and 10B at 5.5 GHz, on the Y-Z plane, the X-Y plane and the X-Z plane, respectively.

Figure 14:
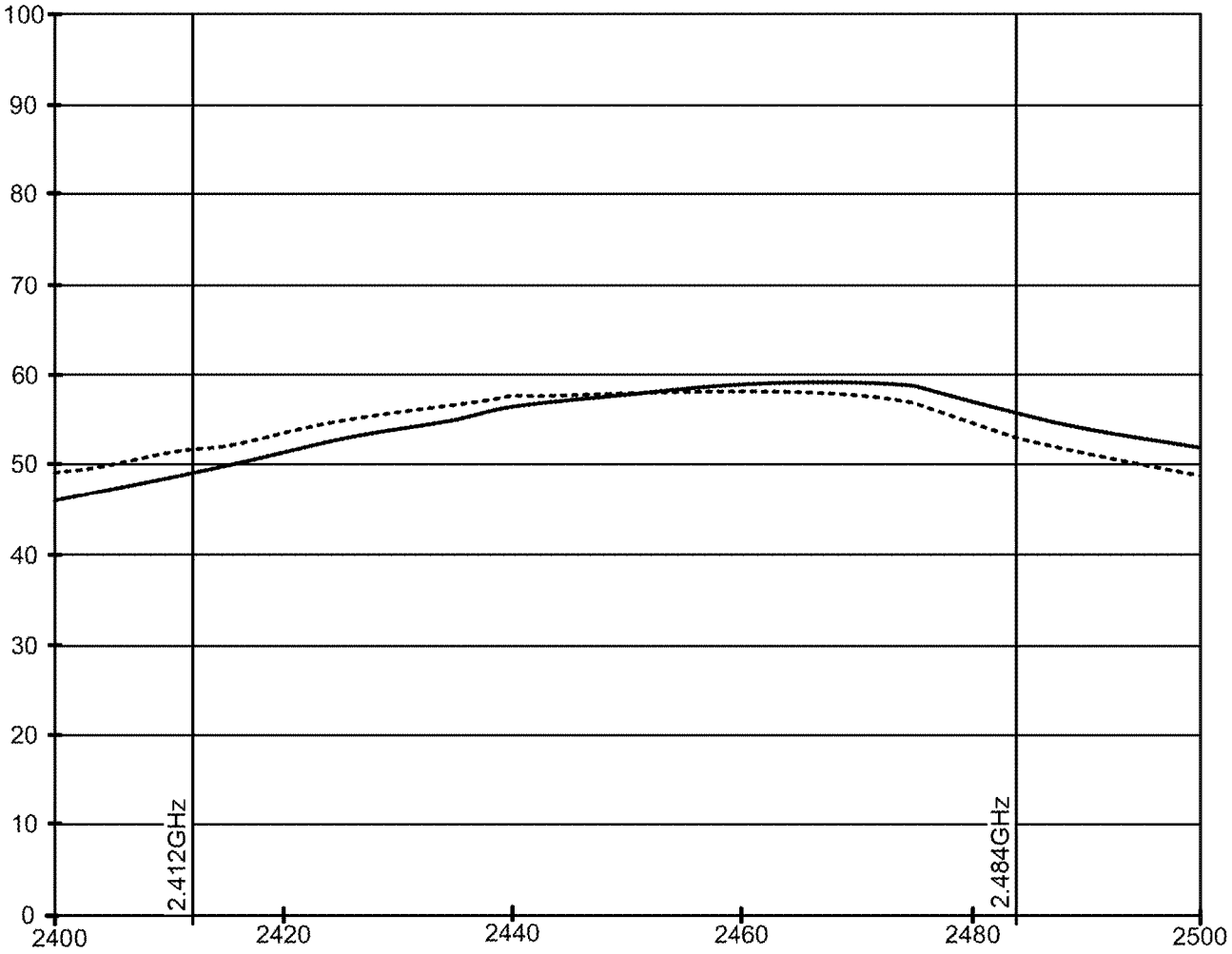
FIG. 14 is a plot illustrating measured efficiency versus frequency for the example illustrated in FIGS. 10A and 10B at 2.45 GHz.
Figure 15:
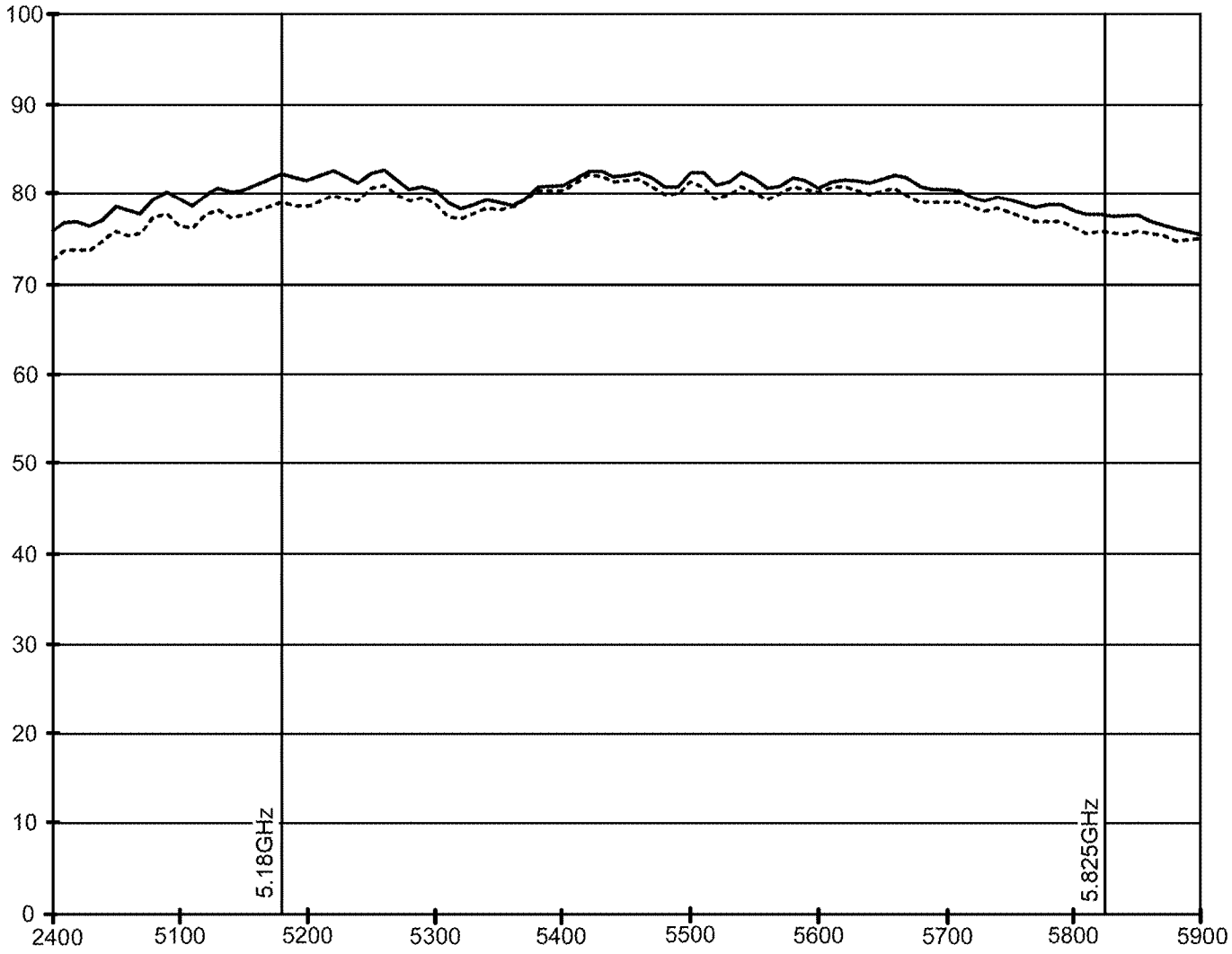
FIG. 15 is a plot illustrating measured efficiency versus frequency for the example illustrated in FIGS. 10A and 10B at 5.5 GHz.

FIG. 14 is a plot illustrating measured efficiency versus frequency for the example illustrated in FIGS. 10A and 10B at 2.45 GHz, and FIG. 15 is a plot illustrating measured efficiency versus frequency for the example illustrated in FIGS. 10A and 10B at 5.5 GHz. In FIG. 14, the near 60% efficiency versus frequency is achieved in the proximity of the 2.45 GHz resonance, in spite of the small device size afforded by the use of C2CPL antennas, while in FIG. 15, the efficiency at 5.5 GHz is near 80%.

Figure 16A:
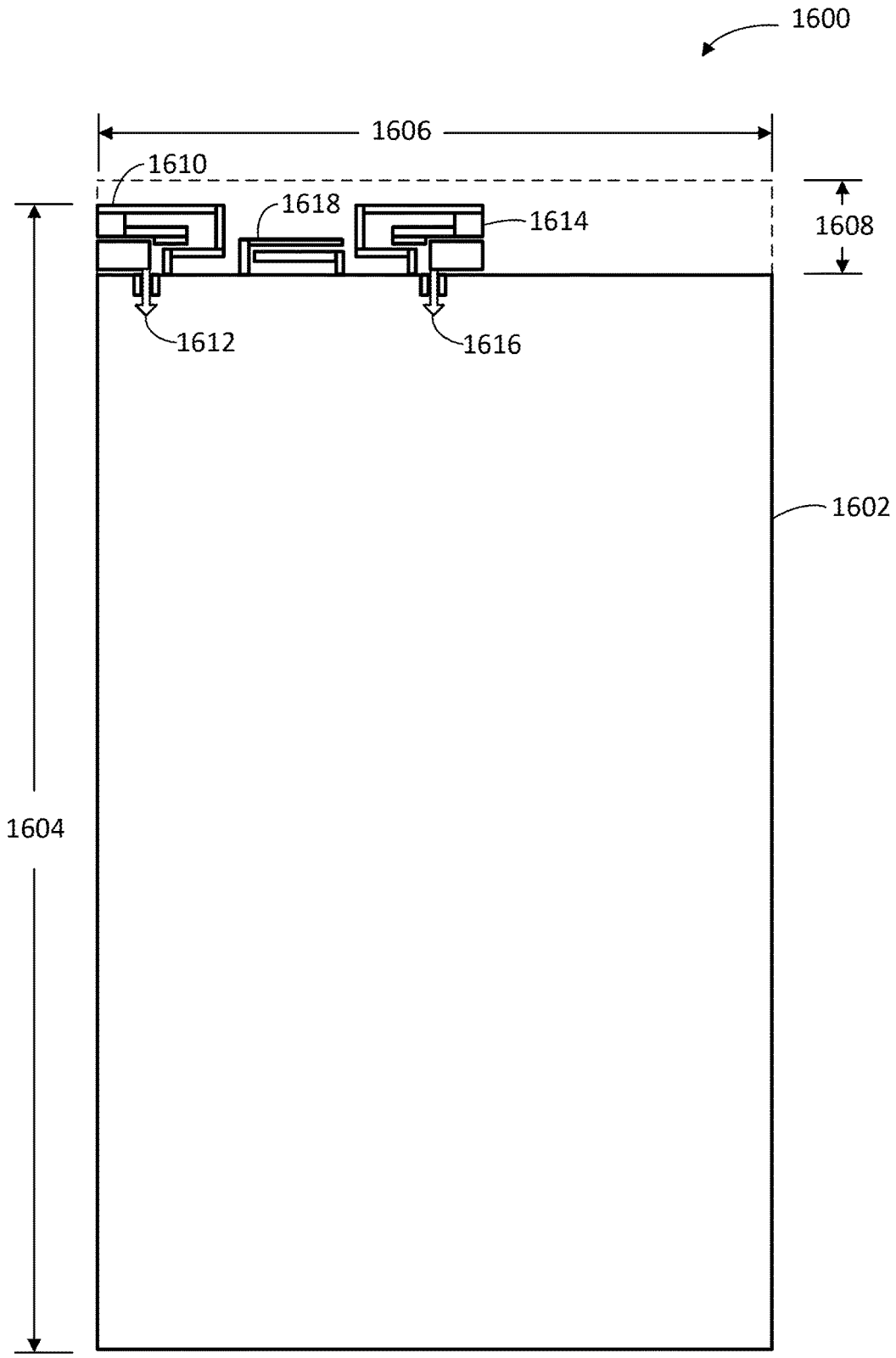
FIGS. 16A and 16B illustrate an example of an antenna system including two CPL antennas and an isolation circuit.
Figure 16B:
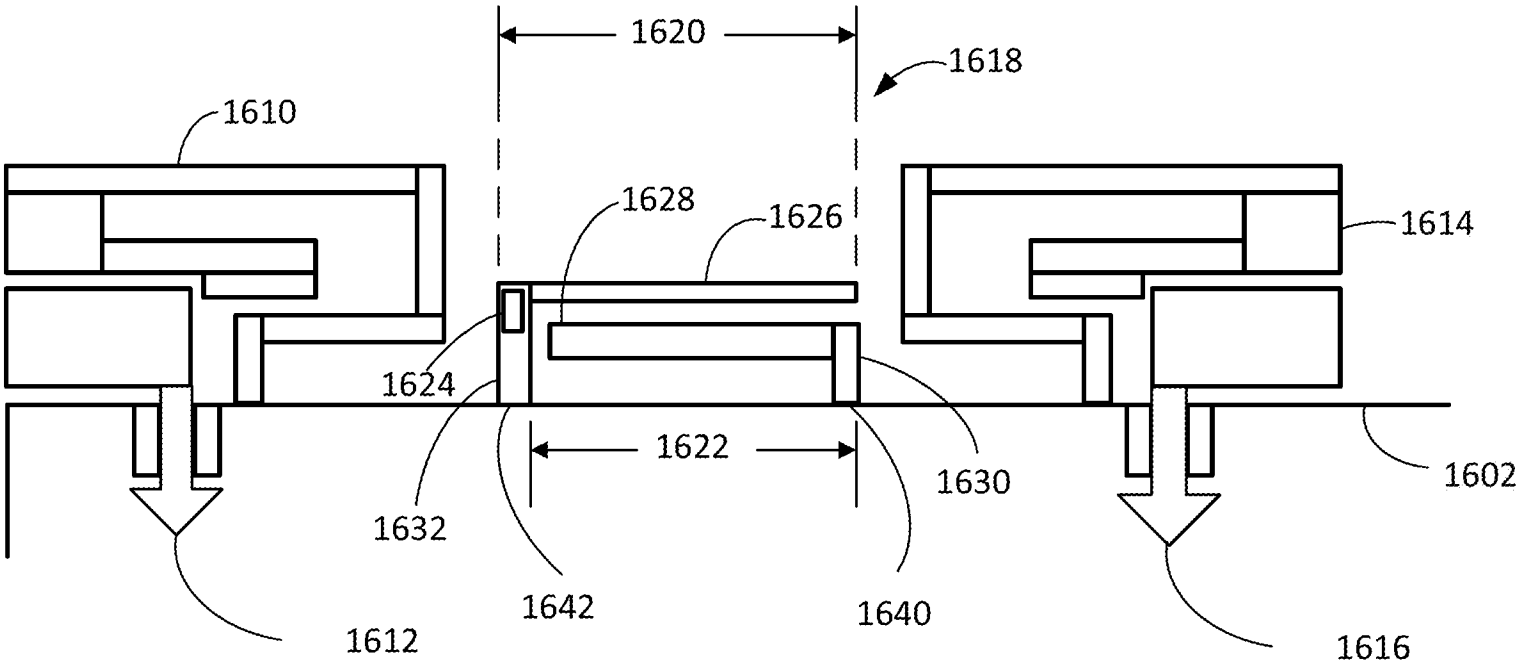

FIGS. 16A and 16B illustrate another example of an antenna system 1600 including a resonant isolator. In one aspect, antenna system 1600 may include two or more antennas, such as CPL or C2CPL antennas 1610 and 1614, spaced at a short electrically distance to one another (e.g., less than a half-wavelength at the operation frequency). Antennas 1610 and 1614 may each be coupled to a computing device, such as via ports 1612 and 1616. Antennas 1610 and 1614 may be coupled to ground plane 1602, which may have dimensions 1604, 1606 corresponding to the interior of a smart phone or other mobile communication device. In one example, dimension 1604 may be approximately 144.5 mm, and dimension 1606 may be approximately 97 mm. In some aspects, antennas 1610 and 1614 may be coplanar to the ground plane 1602, extending lengthwise in a space not including the ground plane, such as having dimension 1608, which in some cases, may be approximately 13 mm. Antenna system 1600 may further include a resonant isolator 1618 that is configured or configurable to couple the antennas 1610 and 1614 to achieve electromagnetic isolation of the antennas 1610 and 1614 at one or more resonance frequencies. Conductive parts of the two-antenna structure and ground planes may be printed on a dielectric substrate such as a PCB, ceramic, alumina, etc.

In one example, the resonant isolator 1618 may include two conductive portions or sections 1626 and 1628 (further illustrated in FIG. 16B), which may be arranged parallel or substantially parallel to one another. Sections 1626 and 1628 may be spaced at different distances from ground plane 1602, and may be electrically coupled to ground plane 1602 via conductive portions 1630 and 1632, respectively. Portions 1626, 1628, 1630, and 1632 may take various shapes and sizes, which may be determined based on the resonant frequency or frequencies of antennas 1610 and 1614 and other design parameters associated with system 1600, such as the size of the ground plane 1602, the coupling location of resonant isolator 1608 to ground plane 1602, and the like.

Conventional methods for enhancing isolation between antennas include a quarter wavelength slot formed in the ground plane, a suspended line, a choke joint, a parasitic stub having a quarter wave length, etc. While these methods may reduce mutual coupling between antennas, they tend to occupy a large amount of space, are only effective for narrow bandwidths, and are not tunable (i.e., not "agile"). As disclosed herein, a resonant circuit may instead be utilized for antenna isolation where there is a resonant frequency or frequencies at which the two antennas need to be isolated.

In general, during operation of two antennas, such as antennas 1610 and 1614, corresponding "hot spots" are generated on the ground plane 1602. These "hot spots" are areas on the ground plane 1602 where high current densities occur. However, because the term "hot spot" is now commonly used to describe physical locations where wireless reception is available, the term "current null point" is used herein instead. Coupling the antennas via these current null points will result in one antenna's radiation energy shifting to the other antenna and vice versa. These current null points can be detected by simulation or electromagnetic analysis.

As depicted in FIG. 16B, the conductive portions 1630 and 1632 of resonant isolator 1618 may be specifically connected or coupled to the ground plane 1602 proximate to the current null points 1640 and 1642, respectively. The current null points 1640 and 1642 are produced by antennas 1610 and 1614. In one example, conductive portions 1626 and 1628 may be coupled to the current null points on the ground plane 1602 via the conductive portions 1630 and 1632, which may be positioned substantially perpendicular or orthogonal to conductive portions 1610 and 1614. Connecting the resonant isolator at the current null points servers to remove or suppress surface current (i.e., "current trapping") on the ground plane between the closely located two antennas. Current trapping reduces the flow of current from the active antenna elements 1610 and 1614 to passively terminated antenna elements. Thus, the signals transmitted from or received by each antenna 1610 and 1614 may be associated substantially with the respective E-field energy of that antenna, thereby allowing the antennas to operate independent of one another, i.e., resonantly isolated. The resonant frequency or frequencies as well as the degree of isolation may be controlled by adjusting the dimensions and shapes of the resonant isolator 1618 and/or variable or active electronic elements or components that may be included therein.

In one example, resonant isolator 1618 may be passive, such that it includes passive components. Resonant isolator 1618 may be printed on a PCB or similar material or structure. In some cases, the resonant isolator 1618 may include discrete capacitors, inductors, and/or resistors, may be modeled using conductive portions to provide similar capacitance, inductance, or resistive properties, or a combination thereof, according to the required resonant frequency or frequencies of antennas 1610 and 1614.

In one example, parameters 1620 and 1622 may be adjusted to provide an additional degree of freedom for frequency operation, i.e., different resonant frequencies or operating frequencies of antennas 1610 and 1614. Adjusting parameters 1620 and 1622 may be performed at the design stage, such as selecting physical lengths of conductive portions 1626 and 1628 based on the operational resonant frequency or frequencies of antennas 1610 and 1614. In some aspects, adjusting parameters 1620 and 1622 may include adjusting the physical length of conductive portions 1626 and 1628 and/or adding one or more discrete passive components to achieve certain electrical lengths for portions 1626 and 1628. In other examples, parameters 1620 and/or 1622, which may include an electrical length, may be adjusted by activating an active element 1624, which may include a power source, transistor, etc. In this way, antenna system 1600 may be tuned and/or adjusted for different operational frequencies and/or different operating conditions.

Figure 17D:
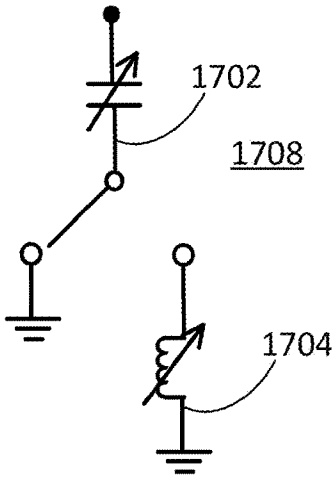
FIGS. 17A, 17B, 17C, 17D and 17E illustrate examples of active elements.
Figure 17C:
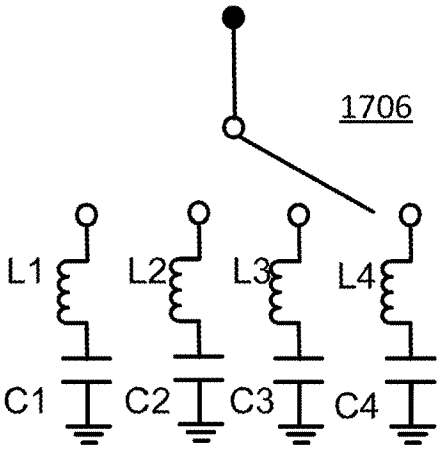
Figure 17B:
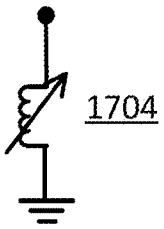
Figure 17A:
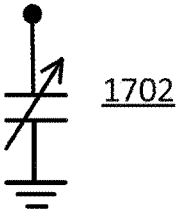
Figure 17E:
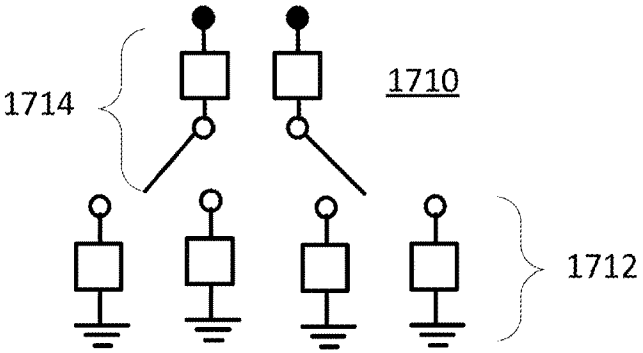

In another example, the active element 1624 may include a switch, a variable capacitor, a tunable inductor, etc., and may be located at any point within the resonant isolator 1618. As illustrated in FIG. 17A, the active element 1624 may be a variable capacitor 1702, which is also called a digital capacitor, wherein the capacitance value is variable. Another example is illustrated in FIG. 17B, where the active element 1624 is a tunable inductor 1704, wherein the inductance value is variable. In yet another example illustrated in FIG. 17C, the active element 1624 is a SP4T (single pole four throw) switch 1706, which has four different combinations of inductance and capacitance (load), wherein the switch may be controlled to select any one of the four different loads. In yet another example illustrated in FIG. 17D, the active element 1624 is a SPDT (single pole double throw) 1708, wherein a variable capacitor 1702 or a combination of a variable capacitor 1702 and a tunable inductor 1704 may be selected. In yet another example illustrated in FIG. 17E, the active element 1624 is a XPYT (X pole Y throw, where X=1, 2, 3 . . . and Y=1, 2, 3 . . . ) 1710, wherein the branches 1712 have respective loads (illustrated by boxes), and the switches 1714 may be controlled to select an optimal load dynamically.

These and other variable components may be used singularly or in any combination thereof to provide the active element 1624. These variable components may be controlled by an external controller to adjust the overall inductance and capacitance values associated with the resonant isolator 1618 for tuning the resonant frequency or frequencies, thereby providing a frequency agile solution. Such frequency tuning is useful, for example, for adapting to environmental changes, i.e., the device being in proximity of a head/hand, metal, etc., that cause frequency shifting. By tuning the frequency, by adjusting the active element 1618, optimal efficiency and throughput can be regained. Alternatively or additionally, the present frequency tuning may be used to move the range of an antenna's reception and/or transmission between different frequency bands in a multi-band application.

Figure 18:
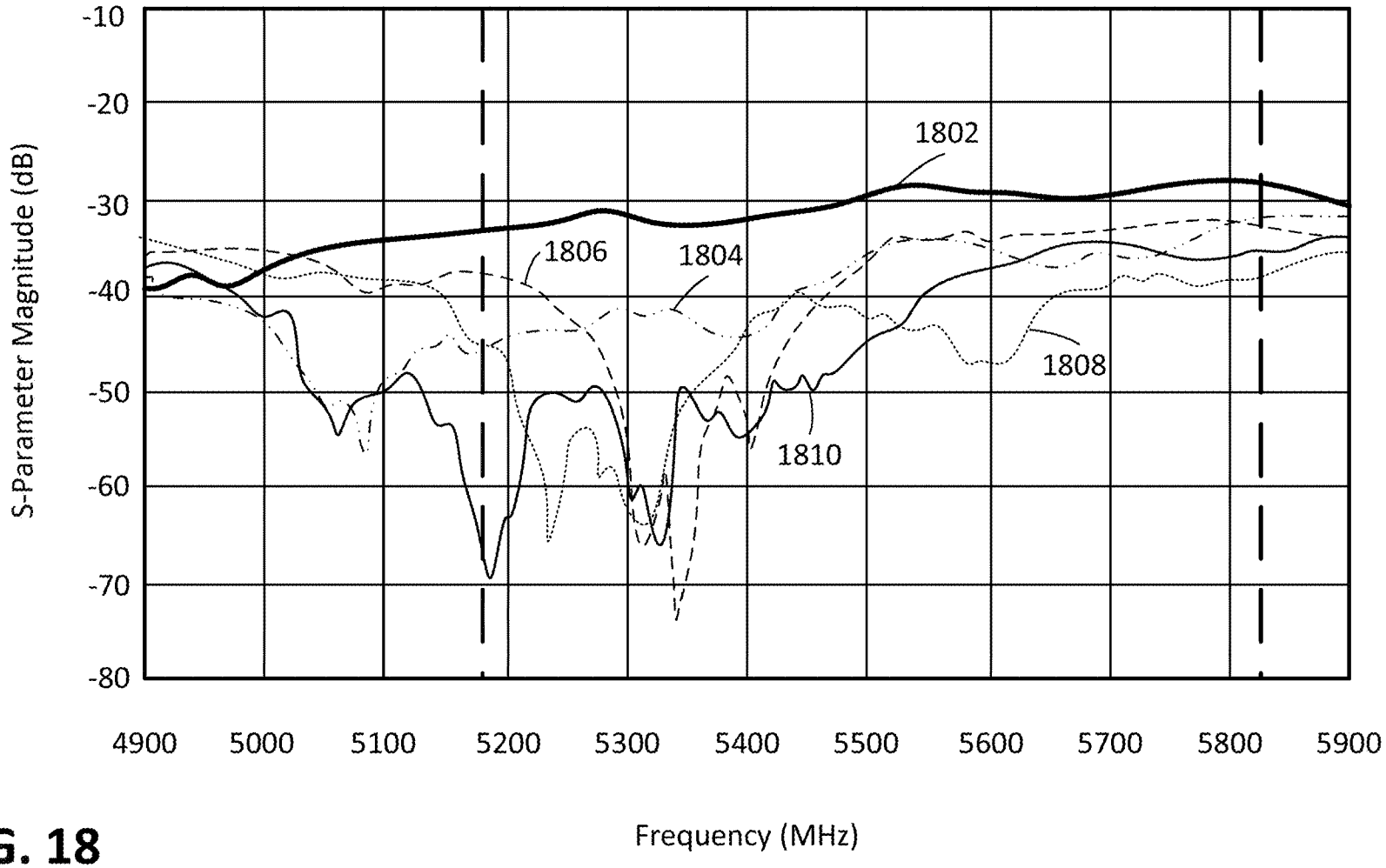
FIG. 18 illustrates an example plot of the measured S parameter for different configurations of the isolation circuit of FIGS. 16A and 16B.
Figure 19A:
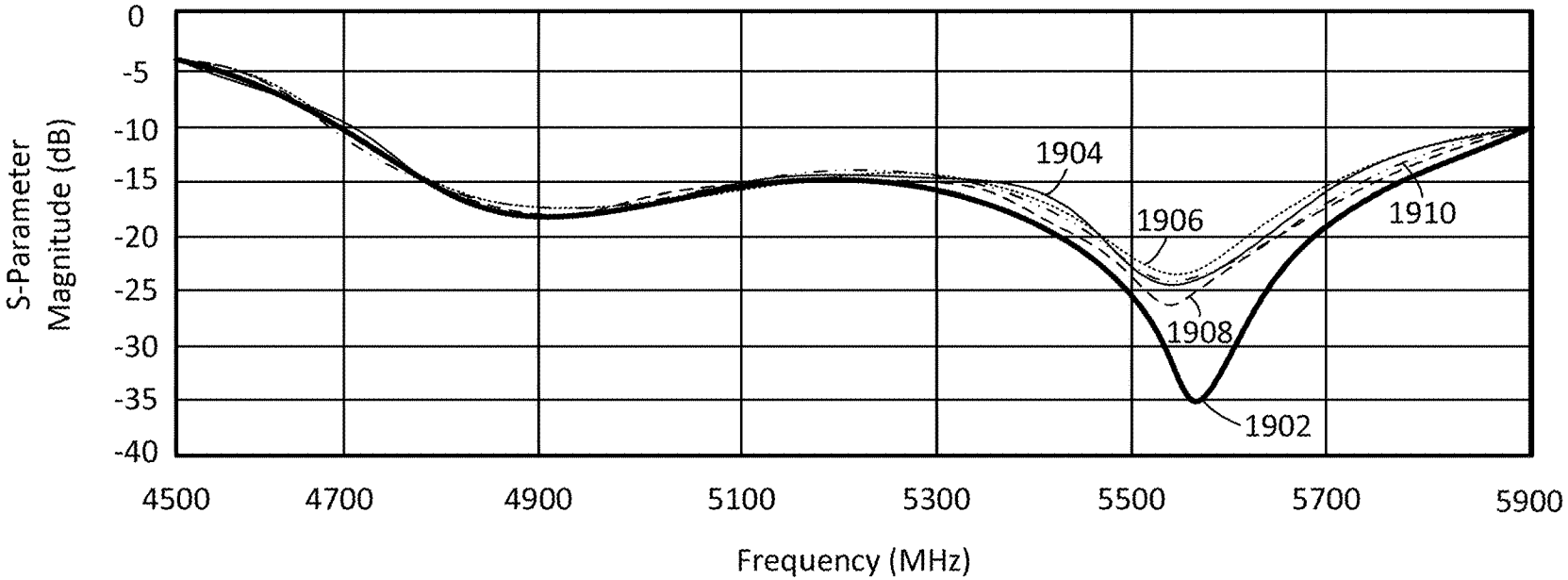
FIGS. 19A and 19B illustrate example plots of measured return loss for the first and second antenna of FIGS. 16A and 16B.
Figure 19B:
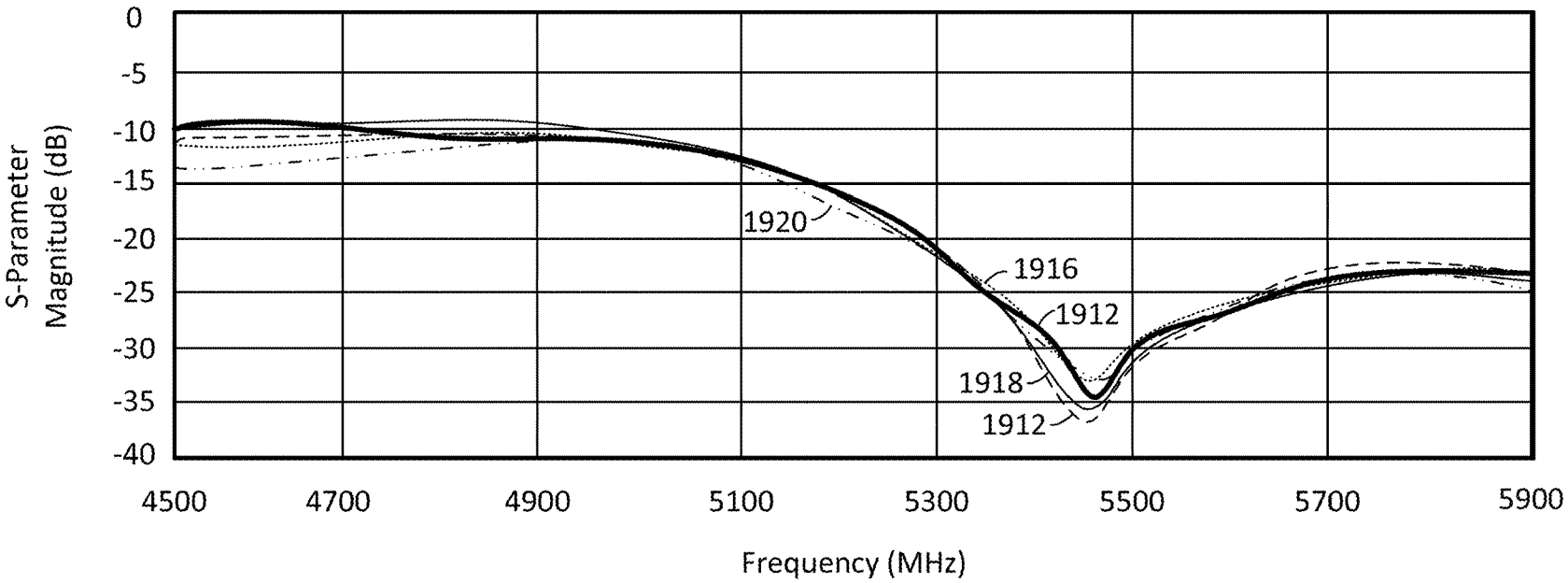

With reference to FIG. 18, an example plot of the measured isolation between two antennas, such as antennas 1610 and 1614 of system 1600, is illustrated. Curve 1802 represents a baseline of isolation between antennas 1610 and 1614, without the resonant isolator 1618 of FIGS. 16A and 16B. Curves 1804, 1806, 1808, and 1810 represent isolation between antennas 1610 and 1614 with the resonant isolator 1618, with different values of parameters 1620 and 1622. As illustrated by FIG. 18, the described resonant isolator may provide a frequency agile solution to multi-antenna systems FIG. 19A illustrates an example plot of the return loss for antenna 1610. Curve 1902 represents the return loss of antenna 1610 without the resonant isolator 1618. Curves 1904, 1906, 1908, and 1910 represent the return loss of antenna 1610 with the resonator isolator, with different values of parameters 1620 and 1622. FIG. 19B illustrates an example plot of the return loss for antenna 1614. Curve 1912 represents the return loss of antenna 1614 without the resonant isolator 1618. Curves 1914, 1916, 1918, and 1920 represent the return loss of antenna 1616 with the resonator isolator, with different values of parameters 1620 and 1622.

In an embodiment, an antenna system comprises a ground plane; a first antenna coupled to the ground plane; a second antenna coupled to the ground plane; and a resonant isolator located between the first antenna and the second antenna, wherein the resonant isolator is coupled to the ground plane at or proximate to a first current null point created by the first antenna and at or proximate to a second current null point created by the second antenna, and wherein the resonant isolator is configured to isolate the first antenna from the second antenna at a resonance.

In the embodiment, the resonant isolator comprises at least two conductive portions. In the embodiment, the at least two conductive portions comprise a first portion having a first length and a second conductive portion having a second length, wherein changing the first length, the second length, or both the first length and the second length changes the resonance at which the resonant isolator isolates the first antenna from the second antenna. In the embodiment, the first length corresponds to a first electrical length and the second length corresponds to a second electrical length. In the embodiment, the resonant isolator comprises passive artwork on printed circuit board (PCB).

In the embodiment, further comprising an active tuning element coupled to the resonant isolator.

In the embodiment, further comprising an active tuning element coupled to the resonant isolator, wherein the active tuning element, upon activation, is configured to change the first electrical length, the second electrical length, or both the first electrical length and the second length to change the resonance at which the resonant isolator isolates the first antenna from the second antenna.

In the embodiment, the resonant isolator is further configured to generate at least one current trap to reduce current flowing from an active one of the first antenna and the second antenna to the other one of the first antenna and the second antenna. In the embodiment, wherein at least one of the first antenna or the second antenna comprises a compound loop (CPL) antenna. In the embodiment, wherein the first antenna and the second antenna are coplanar with the resonant isolator.

In an embodiment, an antenna system comprises a ground plane; a first compound loop antenna coupled to the ground plane; a second compound loop antenna coupled to the ground plane; and a resonant isolator comprising two substantially parallel conductive portions, the resonant isolator located proximate to the first compound loop antenna and the second compound loop antenna, wherein the resonant isolator is coupled to the ground plane at or proximate to at least one current null point created by at least one of the first compound loop antenna or the second compound loop antenna, and is configured to isolate the first compound loop antenna from the second compound loop antenna at a resonance.

In the embodiment, wherein the two conductive portions comprise a first portion having a first length and a second conductive portion having a second length, wherein changing the first length, the second length, or both the first length and the second length changes the resonance at which the resonant isolator isolates the first compound loop antenna from the second compound loop antenna. In the embodiment, wherein the first length corresponds to a first electrical length and the second length corresponds to a second electrical length. In the embodiment, wherein the resonant isolator comprises passive artwork on printed circuit board (PCB).

In the embodiment, further comprising an active tuning element coupled to the resonant isolator.

In the embodiment, further comprising an active tuning element coupled to the resonant isolator, wherein the active tuning element, upon activation, is configured to change the first electrical length, the second electrical length, or both the first electrical length and the second length to change the resonance at which the resonant isolator isolates the first compound loop antenna from the second compound loop antenna.

In the embodiment, wherein the resonant isolator is further configured to generate at least one current trap to reduce current flowing from an active one of the first compound loop antenna and the second compound loop antenna to the other one of the first compound loop antenna and the second compound loop antenna. In the embodiment, wherein the resonant isolator is further configured to generate at least one current trap to reduce current flowing from an active one of the first compound loop antenna and the second compound loop antenna to the other one of the first compound loop antenna and the second compound loop antenna. In the embodiment, wherein the first compound loop antenna and the second compound loop antenna are coplanar with the resonant isolator.

While this document contains many specifics, these should not be construed as limitations on the scope of the disclosure or of what may be claimed, but rather as descriptions of features specific to particular embodiments of the disclosure. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be exercised from the combination, and the claimed combination may be directed to a subcombination or a variation of a subcombination.

What is claimed:

1. An antenna system, the system comprising:

a ground plane;

a first antenna coupled to the ground plane;

a second antenna coupled to the ground plane; and a resonant isolator located between the first antenna and the second antenna, wherein the resonant isolator is coupled to the ground plane at or proximate to a first current null point created by the first antenna and at or proximate to a second current null point created by the second antenna, the first current null point and the second current null point each being an area on the ground plane where high current density occurs, and wherein the resonant isolator comprises at least two substantially parallel conductive portions and is configured to isolate the first antenna from the second antenna at a resonance.

2. The antenna system of claim 1, wherein the at least two conductive portions comprise a first conductive portion having a first length and a second conductive portion having a second length, wherein changing the first length, the second length, or both the first length and the second length changes the resonance at which the resonant isolator isolates the first antenna from the second antenna.

3. The antenna system of claim 2, wherein the first length corresponds to a first electrical length and the second length corresponds to a second electrical length.

4. The antenna system of claim 3, further comprising:

an active tuning element coupled to the resonant isolator, wherein the active tuning element, upon activation, is configured to change the first electrical length, the second electrical length, or both the first electrical length and the second length to change the resonance at which the resonant isolator isolates the first antenna from the second antenna.

5. The antenna system of claim 1, wherein the resonant isolator comprises a passive artwork on a printed circuit board (PCB).

6. The antenna system of claim 1, further comprising:

an active tuning element coupled to the resonant isolator.

7. The antenna system of claim 1, wherein the resonant isolator is further configured to generate at least one current trap to reduce current flowing from an active one of the first antenna and the second antenna to the other one of the first antenna and the second antenna.

8. The antenna system of claim 1, wherein at least one of the first antenna or the second antenna comprises a compound loop (CPL) antenna.

9. The antenna system of claim 1, wherein the first antenna and the second antenna are coplanar with the resonant isolator.

10. An antenna system, the system comprising:

a ground plane;

a first compound loop antenna coupled to the ground plane;

a second compound loop antenna coupled to the ground plane; and a resonant isolator comprising two substantially parallel conductive portions, the resonant isolator located proximate to the first compound loop antenna and the second compound loop antenna, wherein the resonant isolator is coupled to the ground plane at or proximate to at least one current null point created by at least one of the first compound loop antenna or the second compound loop antenna, the at least one current null point being an area on the ground plane where high current density occurs, and is configured to isolate the first compound loop antenna from the second compound loop antenna at a resonance.

11. The antenna system of claim 10, wherein the two substantially parallel conductive portions comprise a first conductive portion having a first length and a second conductive portion having a second length, wherein changing the first length, the second length, or both the first length and the second length changes the resonance at which the resonant isolator isolates the first compound loop antenna from the second compound loop antenna.

12. The antenna system of claim 11, wherein the first length corresponds to a first electrical length and the second length corresponds to a second electrical length.

13. The antenna system of claim 12, further comprising:

an active tuning element coupled to the resonant isolator, wherein the active tuning element, upon activation, is configured to change the first electrical length, the second electrical length, or both the first electrical length and the second length to change the resonance at which the resonant isolator isolates the first compound loop antenna from the second compound loop antenna.

14. The antenna system of claim 10, wherein the resonant isolator comprises a passive artwork on a printed circuit board (PCB).

15. The antenna system of claim 10, further comprising:

an active tuning element coupled to the resonant isolator.

16. The antenna system of claim 10, wherein the resonant isolator is further configured to generate at least one current trap to reduce current flowing from an active one of the first compound loop antenna and the second compound loop antenna to the other one of the first compound loop antenna and the second compound loop antenna.

17. The antenna system of claim 10, wherein the first compound loop antenna and the second compound loop antenna are coplanar with the resonant isolator.

* * * * *